US007780023B2

(12) United States Patent
Py et al.

(10) Patent No.: US 7,780,023 B2
(45) Date of Patent: Aug. 24, 2010

(54) READY TO DRINK CONTAINER WITH NIPPLE AND NEEDLE PENETRABLE AND LASER RESEALABLE PORTION, AND RELATED METHOD

(75) Inventors: Daniel Py, Larchmont, NY (US); Benoit Adamo, Pelham, NY (US); John Guthy, Southbury, CT (US); Nathaniel Houle, Hebron, CT (US); Brian Tulley, Naugatuck, CT (US); Jeffrey Willey, Brookfield, CT (US)

(73) Assignee: Medical Instill Technologies, Inc., New Milford, CT (US)

( * ) Notice: Subject to any disclaimer, the term of this patent is extended or adjusted under 35 U.S.C. 154(b) by 19 days.

(21) Appl. No.: 11/786,206

(22) Filed: Apr. 10, 2007

(65) Prior Publication Data

US 2007/0283666 A1 Dec. 13, 2007

Related U.S. Application Data

(60) Provisional application No. 60/790,684, filed on Apr. 10, 2006.

(51) Int. Cl.
*A61J 9/00* (2006.01)
*A61J 11/04* (2006.01)

(52) U.S. Cl. ..... 215/11.1; 426/117; 426/399

(58) Field of Classification Search ..... 215/11.1; 426/117, 130, 388; 53/373.7, 423
See application file for complete search history.

(56) References Cited

U.S. PATENT DOCUMENTS 3,200,860 A * 8/1965 Benjamin et al. ..... 141/330
3,424,329 A * 1/1969 Hershberg et al. ..... 215/247
4,078,566 A * 3/1978 Urban, Jr. ..... 604/514
4,427,039 A 1/1984 Brooks et al.
4,519,513 A 5/1985 Weiler et al.
4,700,202 A 10/1987 Kuranishi et al.
4,706,827 A 11/1987 Cabernoch et al.
4,821,895 A * 4/1989 Roskilly ..... 215/11.1
4,834,099 A * 5/1989 Schrooten ..... 215/11.1
4,877,065 A 10/1989 Lamboy et al.
5,178,291 A * 1/1993 Piercey ..... 215/11.1
5,354,274 A * 10/1994 Demeter et al. ..... 604/77
5,641,004 A 6/1997 Py
6,032,810 A * 3/2000 Meyers et al. ..... 215/11.1

(Continued)

OTHER PUBLICATIONS

International Search Report and Written Opinion of the International Searching Authority for International Application No. PCT/US07/08961.

*Primary Examiner*—Sue A Weaver
(74) *Attorney, Agent, or Firm*—McCarter & English, LLP

(57) ABSTRACT

A container is provided for storing a product, such as a fat containing liquid product, and includes a body defining a chamber for receiving the product; and a container closure including a sealing portion for sealing the product within the chamber. The container closure includes a member forming a substantially fluid-tight seal between the container closure and the body; a nipple in fluid communication with the chamber that seals the chamber with respect to the ambient atmosphere during storage of the product in the chamber and that can be opened to dispense product from the chamber therethrough; and a needle penetrable and laser resealable portion that is penetrable by the needle for aseptically filling the chamber with the product, and that is thermally resealable by the application of laser radiation thereto to seal the product within the chamber.

31 Claims, 10 Drawing Sheets

U.S. PATENT DOCUMENTS 6,286,697 B1 * 9/2001 Gasparini ..... 215/11.5
6,401,949 B1 * 6/2002 Lyle et al. ..... 215/11.4
6,536,484 B2 3/2003 Hewlitt et al.
6,551,639 B1 4/2003 Nye et al.
6,604,561 B2 8/2003 Py
6,684,916 B2 2/2004 Py
6,708,833 B2 * 3/2004 Kolb ..... 215/11.1
6,786,344 B2 * 9/2004 Kipperman et al. ..... 215/11.1
6,929,040 B2 8/2005 Py
7,100,646 B2 9/2006 Py
7,108,676 B2 * 9/2006 Loging ..... 604/78
7,186,241 B2 3/2007 Py
2004/0188372 A1 9/2004 Ruth et al.
2004/0256026 A1 12/2004 Py

* cited by examiner

READY TO DRINK CONTAINER WITH NIPPLE AND NEEDLE PENETRABLE AND LASER RESEALABLE PORTION, AND RELATED METHOD

CROSS-REFERENCE TO RELATED APPLICATIONS

This application claims priority to U.S. Provisional Application No. 60/790,684, filed Apr. 10, 2006, the contents of which are hereby incorporated by reference in their entirely as part of the present disclosure.

FIELD OF THE INVENTION

The present invention relates to a container having a container closure that is penetrable by a needle to fill the container with a product and is thermally resealable to seal the product within the container, and that includes a nipple for dispensing the product from the container, and to related methods of making and filling such containers.

BACKGROUND INFORMATION

Prior art needle penetrable and laser resealable containers include thermoplastic elastomer ("TPE") stoppers or portions of stoppers that are needle penetrable to needle fill the containers with a product, and are thermally resealable at the resulting needle holes by applying laser radiation thereto to hermetically seal the product within the containers. One of the drawbacks of such TPE stoppers is that they can be difficult to use with fat containing liquid products, such as infant or baby formulas, or other milk-based or low acid products. For example, many such TPE materials contain leachables that can leach into the fat containing product, or otherwise can undesirably alter a taste profile of the product.

Conventional containers and systems for aseptically filling containers with fat containing liquid products, such as infant or baby formulas, or other milk-based or low acid products, employ a container having an open mouth and a screw cap or other type of cap that is secured to the open mouth after aseptically filling the container with the product. In many such systems, the open containers are pre-sterilized by flushing the interior and exterior surfaces of the open containers with a fluid sterilant, such as peroxide vapor or vaporized hydrogen peroxide, to sterilize the food contacting surfaces. Then, the containers are flushed with heated sterile air in order to re-vaporize any fluid sterilant that condenses on the container surfaces and to flush away the sterilant. After flushing with heated sterile air, the open containers are filled through the open mouths of the containers with the desired product, and after filling, the containers are capped to seal the produce within the containers. Typically, the sterilizing, flushing, filling and capping processes are all performed within the same sterile zone of the filling system.

One of the drawbacks of this type of filling system is that it can be difficult to remove all of the fluid sterilant from the interior surfaces of the containers, thus leaving sterilant residue, such as hydrogen peroxide, within the containers and thereby contaminating the product filled into the containers. If the level of residue is sufficiently high, the product must be discarded. Alternatively, the sterilant residue can negatively affect the taste or taste profile of the product.

Another drawback of such prior art systems is that because the sterilizing, flushing, filling and capping processes are all performed within the same sterile zone, the apparatus forming the sterile zone tends to be relatively large and complex.

Moreover, because the product is open filled (i.e., poured into the open mouths of the containers), the product is not as well contained within the sterile zone as otherwise desired, thus creating hygiene problems within the sterile zone. Such apparatus can require cleaning more frequently than desired due, for example, to the collection of sterilant and/or product residue within the sterile zone. Cleaning such large and complex apparatus can result in substantial down time and expense. As a result, such prior art systems can have undesirably short run times between cleaning and sterilization of the sterile zone. Yet another drawback of such systems is that because they sterilize the packaging, fill and seal apparatus all within the same enclosure and sterile zone, if any part of the system goes down, the entire system must be subjected to clean in place ("CIP") and sterilize in place ("SIP") procedures prior to re-starting, which can further contribute to substantial down time and expense.

Yet another drawback of such prior art systems is that the containers are filled immediately prior to capping resulting in poor closure seals due to the presence of wet product at the sealing surfaces or interfaces.

A further drawback of prior art containers and systems for aseptically filling containers with fat containing liquid products, such as infant or baby formulas, or other milk-based or low acid products, is that in order to drink or otherwise dispense the product, the screw cap or other type of closure must first be removed from the open mouth of the container. Then, the product is poured into a different container, such as a baby bottle having nipple, or a container closure having a nipple is screwed onto the open mouth of the container. These procedures not only can be inconvenient and time consuming, but can lead to spillage and/or contamination of the product.

Another drawback of such prior art systems is that in many cases product must be sterilized after filling by employing a retort process that can undesirably alter the taste of the product.

Accordingly, it is an object of the present invention to overcome one or more of the above-described drawbacks and disadvantages of the prior art.

SUMMARY OF THE INVENTION

In accordance with a first aspect, the present invention is directed to a container for storing a product, wherein the container is penetrable by an injection member, such as a filling needle, for aseptically filling the container with a product through the injection member, and a resulting penetration hole in the container is thermally resealable to seal the product within the container. The container comprises a body defining a chamber for receiving the product, and a container closure for sealing the product within the container. The container closure includes a sealing portion forming a substantially fluid-tight seal between the container closure and the body, and a nipple connectable in fluid communication with the chamber, wherein the container closure seals the chamber with respect to the ambient atmosphere during storage of the product in the chamber and can be opened to dispense product from the chamber therethrough; and a penetrable and thermally resealable portion that is penetrable by the injection member for aseptically filling the chamber with the product through the injection member, and that is thermally resealable to seal the product within the chamber.

In accordance with another aspect, the container closure includes one of: (i) the penetrable and thermally resealable portion, (ii) the nipple, or (iii) the penetrable and thermally resealable portion and the nipple.

In accordance with another aspect, the nipple includes a sealing member that is movable between a first position sealing the nipple, and a second position opening the nipple and allowing product in the storage chamber to be dispensed therethrough. In one embodiment of the invention, the sealing member is frangibly connected to the nipple such that in the first position the sealing member is connected to the nipple, and in the second position the sealing member is disconnected from the nipple to form at least one opening in the nipple to allow product to be dispensed therethrough. In certain embodiments of the present invention, the container closure defines a central region and the nipple is laterally spaced relative to the central region.

In accordance with another aspect, the nipple is defined by a first material portion forming an internal surface in fluid communication with the chamber and defining at least most of the surface area of the container closure that can contact any product within the chamber. The penetrable and thermally resealable portion is defined by a second material portion that either (i) overlies the first material portion and cannot contact any product within the chamber, or (ii) forms a substantially lesser surface area of the container closure that can contact any product within the chamber in comparison to the first material portion.

In one embodiment of the present invention, the product is a fat containing liquid product; the body does not leach more than a predetermined amount of leachables into the fat containing liquid product and does not undesirably alter a taste profile of the fat containing liquid product; the first material portion does not leach more than the predetermined amount of leachables into the fat containing liquid product or undesirably alter a taste profile of the fat containing liquid product; and the predetermined amount of leachables is less than about 100 PPM.

The container closure preferably further includes a sealing portion engageable with the body prior to aseptically filling the chamber with the product and forming a substantially dry hermetic seal between the container closure and body. In one embodiment of the present invention, the container closure further includes a securing portion connectable to the body for securing the container closure to the body. In certain embodiments of the present invention, the securing portion is either threadedly connected to or snap-fit to the body. In one such embodiment, the securing member is relatively rigid in comparison to the nipple and the penetrable and resealable portion, and is interposed therebetween.

In accordance with another aspect, the container closure includes an injection member contacting surface that contacts the injection member during withdrawal from the penetrable and resealable portion to substantially remove product thereon. In certain embodiments of the invention, the injection member contacting surface extends about a peripheral portion of the injection member and is in contact therewith. Preferably, the injection member contacting surface is located on an underside of the penetrable and thermally resealable portion, and the injection member contacting surface is defined by the first and/or second material portions. In certain embodiments of the present invention, the second material portion is compressed inwardly in the penetration region thereof to facilitate resealing a penetration hole formed therethrough.

In some embodiments of the present invention, the first material portion is selected from the group including (i) a low mineral oil or mineral oil free thermoplastic; (ii) a low mineral oil or mineral oil free thermoplastic defining a durometer within the range of about 20 Shore A to about 50 Shore A; (iii) a liquid injection moldable silicone; and (iv) a silicone.

In certain embodiments of the present invention, the penetrable and thermally resealable portion is a thermoplastic elastomer that is heat resealable to hermetically seal a penetration aperture by applying laser radiation at a predetermined wavelength and power thereto, and defines (i) a predetermined wall thickness, (ii) a predetermined color and opacity that substantially absorbs the laser radiation at the predetermined wavelength and substantially prevents the passage of radiation through the predetermined wall thickness thereof, and (iii) a predetermined color and opacity that causes the laser radiation at the predetermined wavelength and power to hermetically seal the penetration aperture in a predetermined time period of less than or equal to about 5 seconds and substantially without burning the second material portion.

Also in certain embodiments of the present invention, the penetrable and thermally resealable portion is a thermoplastic elastomer that is heat resealable to hermetically seal a penetration aperture by applying laser radiation at a predetermined wavelength and power thereto, and includes (i) a styrene block copolymer; (ii) an olefin; (iii) a predetermined amount of pigment that allows the second material portion to substantially absorb laser radiation at the predetermined wavelength and substantially prevent the passage of radiation through the predetermined wall thickness thereof, and hermetically seal the penetration aperture in a predetermined time period of less than or equal to about 5 seconds; and (iv) a predetermined amount of lubricant that reduces friction forces at an interface of the injection member and second material portion during penetration thereof.

Also in certain embodiments of the present invention, the penetrable and thermally resealable portion is a thermoplastic elastomer that is heat resealable to hermetically seal a penetration aperture by applying laser radiation at a predetermined wavelength and power thereto, and includes (i) a first polymeric material in an amount within the range of about 80% to about 97% by weight and defining a first elongation; (ii) a second polymeric material in an amount within the range of about 3% to about 20% by weight and defining a second elongation that is less than the first elongation of the first polymeric material; (iii) a pigment in an mount that allows the second material portion to substantially absorb laser radiation at the predetermined wavelength and substantially prevent the passage of radiation through the predetermined wall thickness thereof, and hermetically seal a penetration aperture in a predetermined time period of less than or equal to about 5 seconds; and (iv) a lubricant in an amount that reduces friction forces at an interface of the injection member and second material portion during penetration thereof.

In some embodiments of the present invention, the container closure further includes a first relatively rigid container closure member mounted on the body, a substantially fluid-tight seal formed between the first relatively rigid container closure member and the body, and a second relatively rigid container closure member mounted on the first relatively rigid container closure member. At least a portion of the nipple and/or the penetrable and thermally resealable portion is secured between the first and second relatively rigid container closure members. In some such embodiments, the nipple defines a base portion extending about a periphery of the nipple and seated between the first and second relatively rigid container closure members, and the needle penetrable and thermally resealable portion defines a base portion seated between the first and second relatively rigid container closure members. In some such embodiments, each base portion is compressed between the first and second relatively rigid container closure members.

In accordance with another aspect, the present invention is directed to a container for storing a product, wherein the container is penetrable by an injection member, such as a filling needle, for aseptically filling the container with a product through the injection member, and a resulting penetration hole in the container is thermally resealable to seal the product within the container. The container comprises first means for providing a chamber for receiving the product; and second means for closing the chamber of the first means. The second means includes third means for forming a substantially fluid-tight seal between the first means and the second means; fourth means for insertion into a user's mouth and drawing with the mouth product from the chamber therethrough; fifth means for sealing the fourth means during storage of the product within the container and for opening the fourth means prior to dispensing product therethrough; and sixth means for allowing penetration of the second means by the injection member for aseptically filling the chamber with the product through the injection member, and for allowing thermal resealing of the second means to seal the product within the chamber.

In certain embodiments of the present invention, the first means is a container body; the second means is a container closure; the third means is a sealing member; the fourth means is a nipple; the fifth means is a sealing member that is movable between a first position sealing the nipple and a second position opening the nipple and allowing product in the storage chamber to be dispensed therethrough; and the sixth means is a penetrable and thermally resealable elastomeric portion that is penetrable by the injection member for aseptically filling the chamber with the product through the injection member, and that is thermally resealable to seal the product within the chamber by the application of laser radiation thereto.

The present invention also is directed to an assembly comprising a container as described above in combination with a filling apparatus. The filling apparatus comprises a needle manifold including a plurality of needles spaced relative to each other and movable relative to a container support for penetrating a plurality of containers mounted on the support within the filling apparatus, filling the containers through the needles, and withdrawing the needles from the filled containers. The filling apparatus also includes a plurality of laser optic assemblies, wherein each laser optic assembly is connectable to a source of laser radiation, and is focused substantially on a penetration spot on the penetrable and resealable portion of a respective container closure for applying laser radiation thereto and resealing a respective needle penetration aperture therein.

In accordance with one embodiment of the present invention, the filling apparatus includes a housing defining an inlet end, an outlet end, and a sterile zone between the inlet and outlet ends. A conveyor of the apparatus is located at least partially within the sterile zone and defines a plurality of container positions thereon for supporting and moving containers in a direction from the inlet end toward the outlet end through the sterile zone. A fluid sterilant station is located within the sterile zone and is coupled in fluid communication with a source of fluid sterilant for transmitting fluid sterilant onto the container closure of a respective container supported on the conveyor within the fluid sterilant station, and sterilizing an exposed penetrable and thermally resealable portion of the respective container closure. One or more sterilant removing stations are located within the sterile zone between the fluid sterilant station and the outlet end of the housing, and are coupled in fluid communication with a source of gas for transmitting the gas onto a container supported on the conveyor within the sterilant removing station(s) to flush away fluid sterilant on the container. The needle manifold and laser optic assemblies are located within the sterile zone between the sterilant removing station(s) and the outlet end of the housing for receiving the sterilized containers therefrom.

In one embodiment of the present invention, the fluid sterilant is hydrogen peroxide. In one embodiment of the present invention, the filling apparatus further comprises a source of sterile gas coupled in fluid communication with the sterile zone for creating an over pressure of sterile gas within the sterile zone, and means for directing a flow of sterile gas substantially in a direction from the outlet end toward the inlet end of the housing to thereby prevent fluid sterilant from flowing onto containers located adjacent to the needle manifold. In one embodiment of the present invention, the conveyor includes a plurality of pivotally mounted container supports that engage opposing sides of a respective container supported thereon relative to each other, and substantially isolate a sterile portion of the container located above the container supports relative to a portion of the container located below the container supports to thereby prevent any contamination on the lower portion of the container from contaminating the sterile upper portion of the container.

In accordance with another aspect, the present invention is directed to a method for filling a container with a product, storing the product in the container, and dispensing the product therefrom. The method comprises the following steps:

(i) providing a container including a container body defining a sealed, aseptic, empty chamber for receiving the product, a container closure sealing the chamber with respect to the ambient atmosphere, a first portion that is penetrable by an injection member and that is thermally resealable after removal of the injection member therefrom, and a second portion forming a nipple in fluid communication with the chamber that seals the chamber with respect to the ambient atmosphere during storage of the product in the chamber, and that can be opened to dispense product from the chamber therethrough;

(ii) inserting the injection member through the first portion of the container and aseptically introducing product through the injection member and into the chamber;

(iii) withdrawing the injection member from the first portion of the container;

(iv) thermally resealing a resulting penetration aperture in the first portion of the container and, in turn, sealing the chamber and product contained therein with respect to the ambient atmosphere;

(v) aseptically storing the product in the sealed chamber; and (vi) opening the nipple, inserting the nipple into a user's mouth, and dispensing the product through the nipple and into the user's mouth.

In certain embodiments of the present invention, the method further comprises the step of aseptically storing the product within the sealed chamber for a period of at least five days.

In some embodiments of the present invention, the method further comprises the following steps:

(vii) mounting the sealed, empty container on a conveyor, and moving the conveyor through a sterile zone;

(viii) transmitting within the sterile zone a fluid sterilant onto at least an exposed portion of the first portion of the container and, in turn, sterilizing with the fluid sterilant at least the exposed portion;

(ix) transmitting within the sterile zone a gas onto the portion of the container exposed to the fluid sterilant, flushing away with the gas the fluid sterilant from at least the exposed portion of the first portion of the container and, in turn, forming at least a penetration region of the first portion substantially free of fluid sterilant;

(x) penetrating the penetration region of the first portion with a filling needle coupled in fluid communication with a source of the product, and introducing the product through the needle and into the chamber;

(xi) withdrawing the filling needle from the first portion of the container; and (xii) applying laser radiation to a resulting needle aperture in the first portion and, in turn, thermally resealing the first portion and hermetically sealing the product within the chamber.

In some embodiments of the present invention, the product is a fat containing liquid product, and the method further comprises the following steps: providing a container body that does not leach more than a predetermined amount of leachables into the fat containing liquid product and does not undesirably alter a taste profile of the fat containing liquid product; and a container closure assembly including a second portion defining an internal surface in fluid communication with the chamber forming at least most of the surface area of the container closure that can contact any fat containing liquid product received within the chamber and that does not leach more than a predetermined amount of leachables into the fat containing liquid product or undesirably alter a taste profile of the fat containing liquid product. Preferably, the predetermined amount of leachables is about 100 PPM, and the first portion either (i) overlies the second portion and cannot contact any fat containing liquid product received within the chamber, or (ii) forms a substantially lesser surface area of the container closure that can contact any fat containing liquid product received within the chamber in comparison to the second portion.

In certain embodiments of the invention, the method further comprises directing an overpressure of sterile gas within the sterile zone, and directing at least a portion of the sterile gas in a flow direction generally from an outlet end toward an inlet end of the sterile zone to, in turn, prevent fluid sterilant from contacting a container during needle filling thereof.

One advantage of the present invention is that product is aseptically filled by filling through a needle or other injection member into a sealed, empty sterile container and laser resealing the resulting penetration hole. Then, a user can drink directly from the aseptically filled and stored container through the nipple that otherwise is sealed during storage and shelf-life of the container to maintain the aseptic condition of the product.

Other advantages of the present invention will become readily apparent in view of the following detailed description of the currently preferred embodiments and accompanying drawings.

DETAILED DESCRIPTION OF THE CURRENTLY PREFERRED EMBODIMENTS

Figure 1:
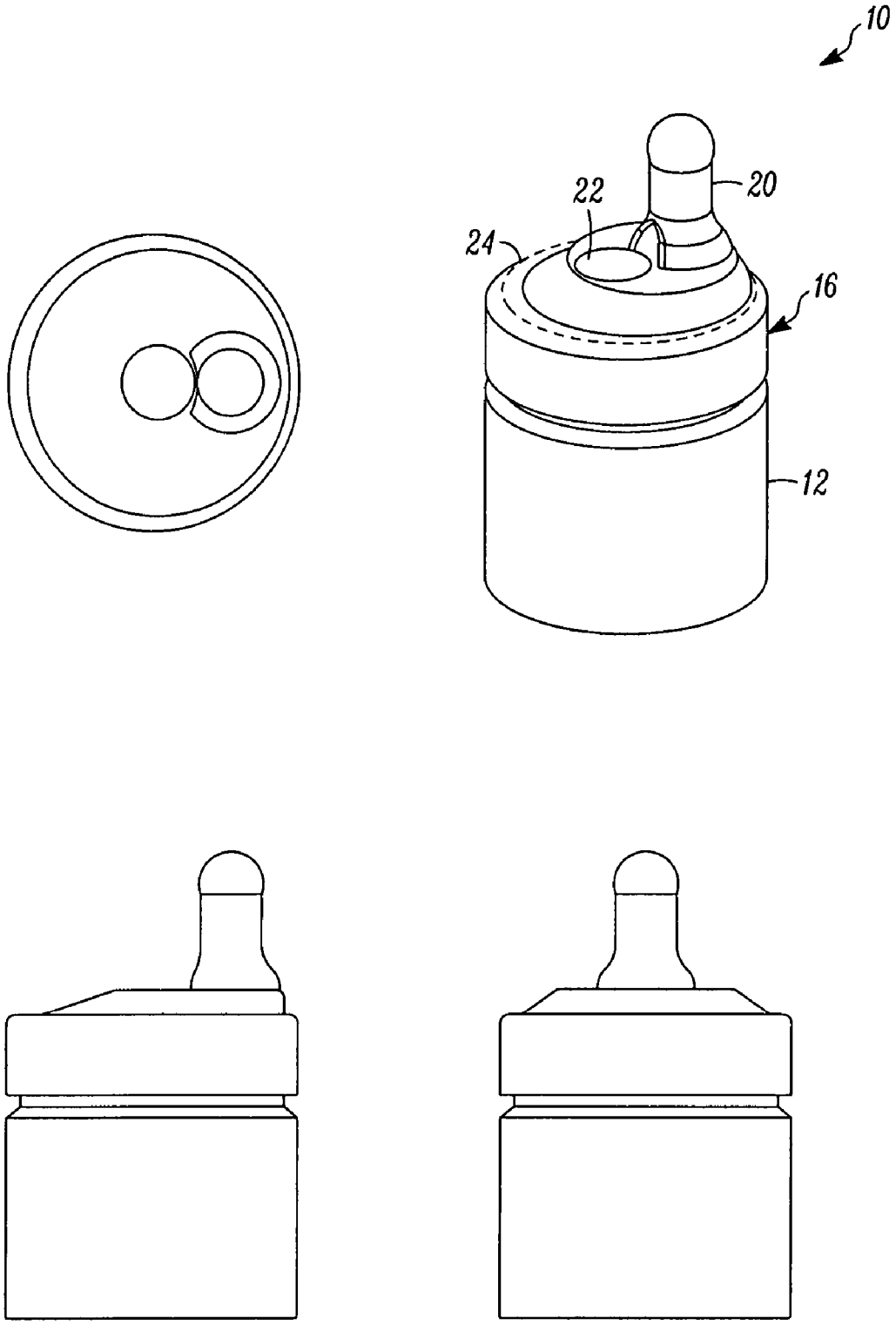
FIG. 1 is an upper perspective view of a first embodiment of a container of the present invention.
Figure 2:
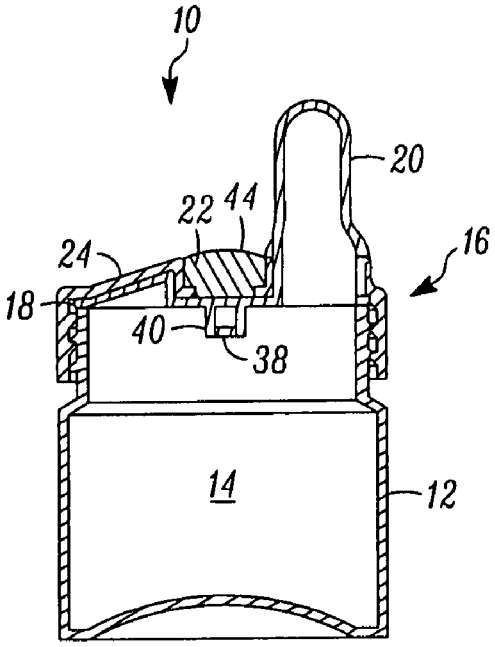
FIG. 2 is a cross-sectional view of the container of FIG. 1.
Figure 3:
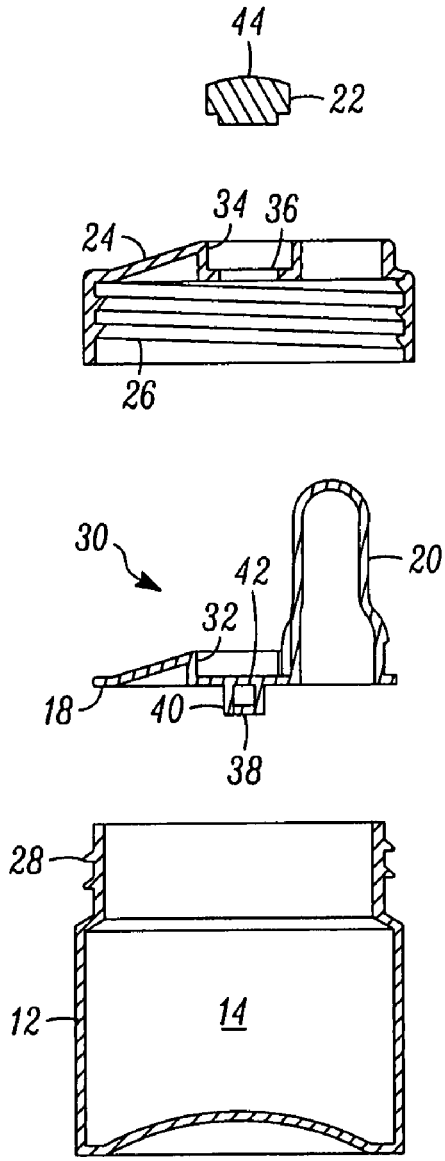
FIG. 3 is an exploded, cross-sectional view of the container of FIG. 1.

In FIGS. 1-3, a container embodying the present invention is indicated generally by the reference numeral 10. As described further below, the container 10 is penetrable by an injection member, such as a filling needle, for aseptically filling the container with a product through the injection member, and a resulting penetration hole in the container is thermally resealable, such as by the application of laser energy thereto, to seal the product within the container. The container 10 comprises a body 12 defining a chamber 14 for receiving the product, and a container closure 16 including a sealing portion 18 extending about the periphery of the container enclosure and forming a substantially fluid-tight seal between the container closure and the body 12. A nipple 20 of the container closure 16 is in fluid communication with the chamber 14. As described further below, the nipple 20 seals the chamber 14 with respect to the ambient atmosphere during storage of the product in the chamber, and when ready to drink, the nipple 20 can be opened to dispense product from the chamber therethrough. The container closure 16 further includes penetrable and thermally resealable portion or stopper 22. As described further below, the stopper 22 is penetrable by the injection member for aseptically filling the chamber 14 with the product through the injection member, and is thermally resealable, such as by the application of laser radiation thereto, to seal the product within the chamber. The container closure 16 further includes a securing portion in the form of a cap 24 that is connectable to the body 12 for securing the container closure to the body. In the illustrated embodiment, the closure cap 24 includes a plurality of female threads 26 and the body includes a plurality of corresponding male threads 28 to threadedly secure the container closure to the body. However, as may be recognized by those of ordinary skill in the pertinent art based on the teachings herein, the container closure may be secured to the body in any of numerous other ways that are currently known, or that later become known, such as by a snap fit. For example, either the container closure or body can include one or more raised portions that are received within one or more recessed portions of the other for securing them together.

As can be seen, in the illustrated embodiment, the sealing member 18 and nipple 20 are formed integral with each other in a first material portion 30. In the illustrated embodiment, the stopper 22 is formed of a second material portion that is formed of a different material than the first material portion 30. As can be seen, the first material portion 30 defines a recess 32 located in an approximately central region thereof for receiving therein a stopper seat 34 formed in the cap 24, and the stopper 22 is received in the stopper seat 34. The stopper seat 34 defines an injection member aperture 36 formed in a base wall thereof for receiving therethrough an injection member, such as a filling needle, during needle filling the container 10. As may be recognized by those of ordinary skill in the pertinent art based on the teachings herein, the stopper, nipple and sealing portions can be formed of the same material, and/or can be formed integral with each other, such as by co-molding. For example, if desired, the stopper 22 can be over molded to the first material portion 30, or vice versa, or one material portion can be superimposed over the other and the two material portions can be mechanically compressed together by, for example, other container closure components. In each case the layers of the first and second material portions are sealed together, such as by mechanical compression, co-molding or insert molding, to prevent germs from ramping in between the two layers and otherwise gaining access to the product within the chamber 14.

The first material portion 30 further defines an injection member contacting surface 38 that is aligned with the injection member aperture 36 of the cap 24 and that contacts the injection member during movement of the injection member through the stopper 22 to, in turn, substantially remove therefrom any product residue on the injection member when it is withdrawn from the stopper. In the illustrated embodiment, the injection member contacting surface 38 is formed by the inner annular surface of a substantially cylindrical boss 40 extending downwardly from a base wall 42 of the stopper recess 32. As can be seen, the base wall 42 of the stopper recess forms a barrier between the stopper 22 and chamber 14, and thus substantially prevents any contact between the stopper and the product stored within the chamber 14. Although the base wall 42 is penetrated by the injection member, it is only necessary that the stopper 22 be thermally resealed in order to seal the product within the chamber. As may be recognized by those of ordinary skill in the pertinent art based on the teachings herein, the injection member contacting surface 38 may take any of numerous different shapes that are currently known, or that later become known, and/or may be formed by the second material portion, by the closure cap, or otherwise.

Figure 6:
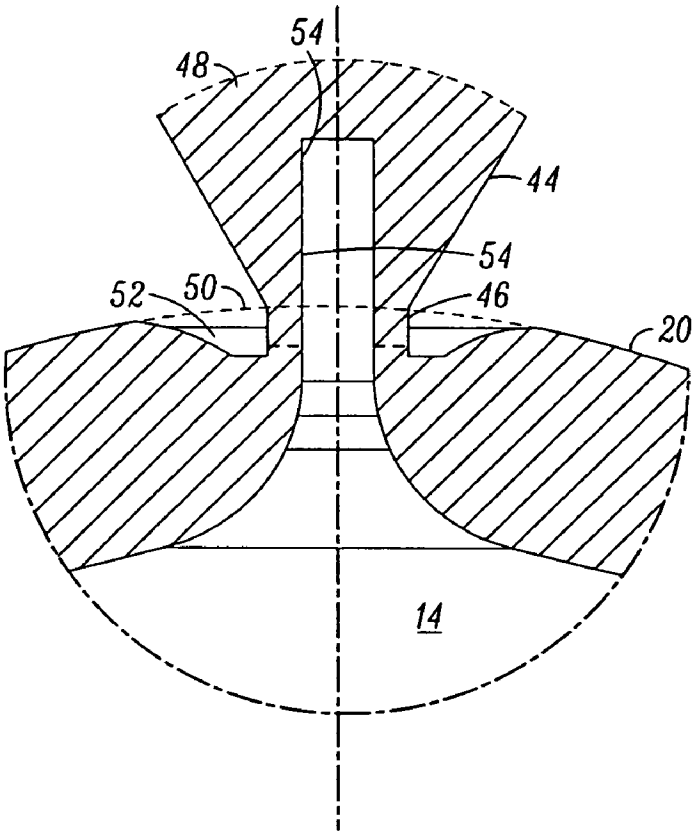
FIG. 6 is a partial, cross-sectional view of the nipple of FIG. 4 showing the frangibly connected sealing member.
Figure 5:
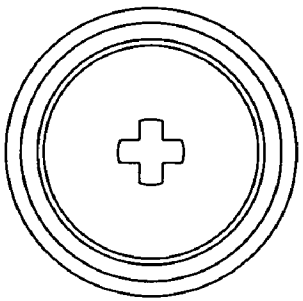
FIG. 5 is a top plan view of the nipple of FIG. 4.
Figure 4:
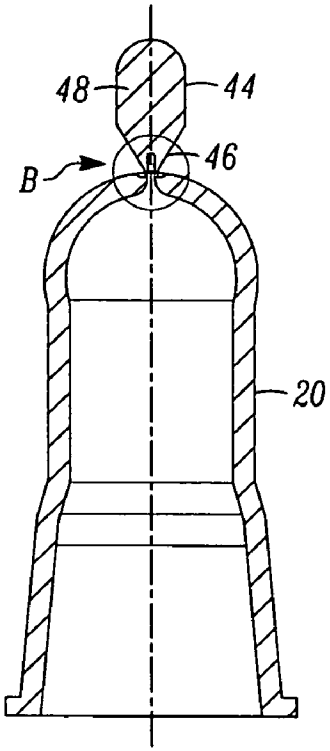
FIG. 4 is a partial, cross-sectional view of a nipple of the container of FIG. 1.

As shown typically in FIGS. 4-6, the nipple 20 includes a sealing member 44 that is movable between a first position sealing the nipple, as shown, and a second position (not shown) opening the nipple and allowing product in the storage chamber 14 to be dispensed therethrough. In the illustrated embodiment, the sealing member 44 is connected to the nipple 20 at a frangible portion 46 extending between the tip of the nipple and a manually engageable portion or grip 48 of the sealing member. Accordingly, in the first position as shown in FIGS. 4-6, the sealing member 44 is connected to the nipple to thereby seal the interior of the nipple, and thus the chamber 14 and product contained therein, with respect to the ambient atmosphere. However, as indicated by the broken line in FIG. 6, the frangible portion 46 of the sealing member 44 is breakable substantially along a break line 50. As also shown in FIG. 6, the break line 50 is located within an annular recess 52 formed within the tip of the nipple. In operation, in order to drink the product from the container, the user manually engages the grip 48 and pulls the sealing member 44 away from the nipple 20. When sufficient force is applied, the frangible portion 46 breaks away from the nipple 20 substantially along the break line 50. As shown in FIG. 6, the sealing member defines an internal elongated recess or bore 54 that is in fluid communication with the interior of the nipple 20 and chamber 14. Thus, when the sealing member 44 is removed, the bore 54 extends through tip of the nipple, and defines a drinking and venting aperture to both permit the product to flow outwardly through the nipple, and air or other gas to flow into the chamber through the nipple. As may be recognized by those of ordinary skill in the pertinent art based on the teachings herein, the sealing member and nipple may take any of numerous different configurations that are currently known, or that later become known. For example, the sealing member can be formed by a plug that is received within a fluid aperture formed in the nipple and that is manually engaged and removed when ready to drink the product. Alternatively, the sealing member may take the form of a projection or tit formed on the nipple, that is snipped or otherwise removed from the nipple to reveal one or more underlying fluid flow apertures through the nipple.

In a currently preferred embodiment of the present invention, the product contained within the storage chamber is a fat containing liquid product. The fat containing liquid product may be any of numerous different products that are currently known, or that later become known, including without limitation infant or baby formulas, growing-up milks, milks, creams, half-and-halfs, yoghurts, ice creams, juices, syrups, condiments, milk-based or milk-containing products, liquid nutrition products, liquid health care products, and pharmaceutical products. As can be seen in FIG. 2, the first material portion 30 defines an internal surface in fluid communication with the storage chamber 14 forming at least most of the surface area of the container closure 16 that can contact any fat containing liquid product within the storage chamber, and that does not leach more than a predetermined amount of leachables into the fat containing liquid product or undesirably alter a taste profile of the fat containing liquid product. In the illustrated embodiment, the first material portion 30 underlies both the stopper 22 and cap 24 and therefore defines substantially all of the surface area of the container closure that can contact any fat containing liquid product within the storage chamber 14.

The term "leachable" is used herein to mean any chemical compound (volatile or non-volatile) that leaches into the product within the container from a component of the container during the period of storage through expiry of the product. An exemplary leachable to be avoided in connection with fat containing liquid nutrition products, such as infant or baby formulas, is mineral oil. Accordingly, as indicated below, in the exemplary embodiments of the present invention, the first material portion 30 does not contain mineral oil, or contains sufficiently low amounts of mineral oil such that it does not leach mineral oil into the fat containing liquid nutrition product, or substantially does not leach mineral oil into the fat containing liquid nutrition product (i.e., if any mineral oil is leached into the product, any such amount is below the maximum amount permitted under applicable regulatory guidelines for the respective product, such as FDA or LFCA guidelines). In accordance with the present invention, the container closure 16 does not leach more than a predetermined amount of leachables into the product. The predetermined amount of leachables is less than about 100 PPM, is preferably less than or equal to about 50 PPM, and most preferably is less than or equal to about 10 PPM.

The second material portion or stopper 22 either (i) overlies the first material portion 30 as shown such that the first material portion forms a barrier between the stopper or second material portion and the product within the storage chamber 14, or (ii) forms a substantially lesser surface area, if any, of the container closure 16 that can contact any fat containing liquid product within the storage chamber 14 in comparison to the first material portion 30. As indicated above, the second material portion or stopper 22 is needle penetrable for aseptically filling the storage chamber 14 with the fat containing liquid product, and a resulting needle hole formed in the second material portion 22 after withdrawing the needle is thermally resealable, such as by the application of laser radiation thereto, to seal the fat containing liquid product within the storage chamber.

One advantage of the container 10 is that the sealing portion 18 of the first material portion 30 is sealed to the body 12 prior to filling the storage chamber 14 with the product, and therefore a dry seal is formed between the container closure and body. As a result, the container 10 can provide significantly higher seal integrity in comparison to prior art containers in which the cap is sealed after filling the container and thus give rise to a significantly higher likelihood of forming a less reliable "wet" seal.

As also shown typically in FIG. 2, the stopper 22 defines a relatively raised upper surface 44 defining the needle penetration and thermally resealable region of the stopper. In the illustrated embodiment, the relatively raised portion is rounded and substantially dome shaped. In addition, the stopper 22 is co-molded with the cap 24, such as by over-molding the stopper within the stopper recess 34 of the cap, or vice versa. Preferably an annular gap is formed between the periphery of the stopper 22 and the adjacent wall of the cap 24 and/or the periphery is the stopper 22 is not attached to the adjacent wall of the cap 24, in order to allow differential thermal expansion and contraction of the stopper and cap and to substantially prevent any such differential thermal expansion or contraction from changing the shape of the stopper or otherwise affecting the ability to form a high integrity seal when thermally resealing a penetration hole formed by a needle or other injection member. One advantage of forming the needle penetrable and thermally resealable stopper in this configuration, e.g., defining a dome or other curvilinear shape, is that the stopper material (i.e., the needle penetrable and thermally resealable portion) is maintained in compression, and thus is substantially self-resealing. Accordingly, when the injection member, such as a filling needle, is removed, the stopper compresses itself about the resulting needle hole, thus closing or substantially closing the needle hole. As a result, when thermally resealed, such as by the application of laser or light energy thereto, a high integrity seal may be obtained. If, on the other hand, the stopper material is in tension, such as may occur if the stopper material is attached about its periphery to the first material portion or cap, it may prevent thermal resealing of the resulting needle hole and/or may prevent the formation of a high integrity seal. If desired, a device (not shown) can be employed to place the needle penetration region of the stopper in compression during needle filling thereof. As may be recognized by those of ordinary skill in the pertinent art based on the teachings herein, although there can be significant advantages derived from the illustrated stopper configuration, or otherwise from placing the needle penetration region of the stopper into compression to facilitate resealing thereof, these and other aspects of the stopper may take any of numerous different shapes and/or configurations that are currently known, or that later become known. In addition, the stopper need not be co-molded with either the cap or the first material portion. For example, the stopper can be press fit within the stopper recess of the cap, or fixedly secured within the recess by an adhesive, ultrasonic welding, or other securing mechanism that is currently known, or that later becomes known. Alternatively, the penetrable and resealable portion can be formed integral with, and of the same material as, the first material portion.

Figure 7:
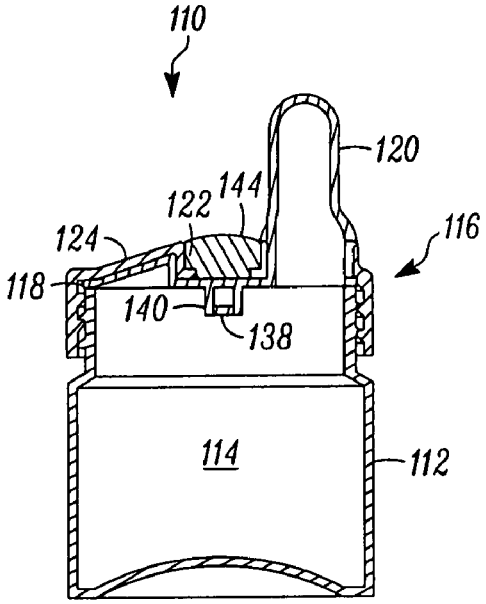
FIG. 7 is a cross-sectional view of a second embodiment of a container of the present invention.
Figure 8:
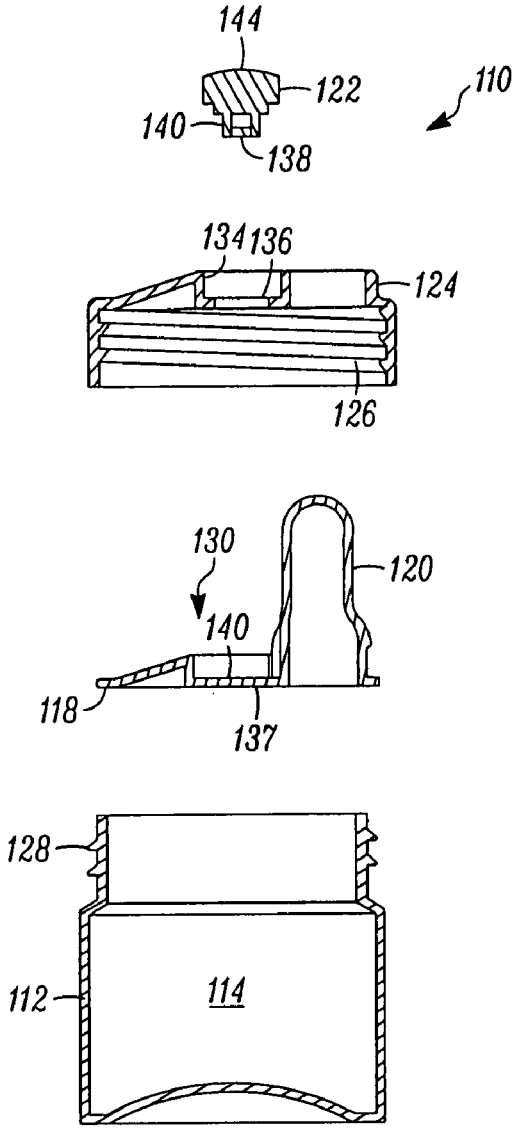
FIG. 8 is an exploded, cross-sectional view of the container of FIG. 7.

In FIGS. 7 and 8 another container embodying the present invention is indicated generally by the reference numeral 110. The container 110 is substantially similar to the container 10 described above with reference to FIGS. 1 through 6, and therefore like reference numerals preceded by the numeral "1" are used to indicate like elements. The primary difference of the container 110 in comparison to the container 10 is that the injection member contacting surface 138 and associated boss or cylindrical wall 140 are formed at the base of the stopper 122. In addition, the base wall 142 of the stopper recess 32 of the second material portion 30 defines an aperture 137 for receiving therethrough the boss of cylindrical wall 140 of the stopper. In certain circumstances, this embodiment may be easier mold than the embodiment described above.

Figure 9:
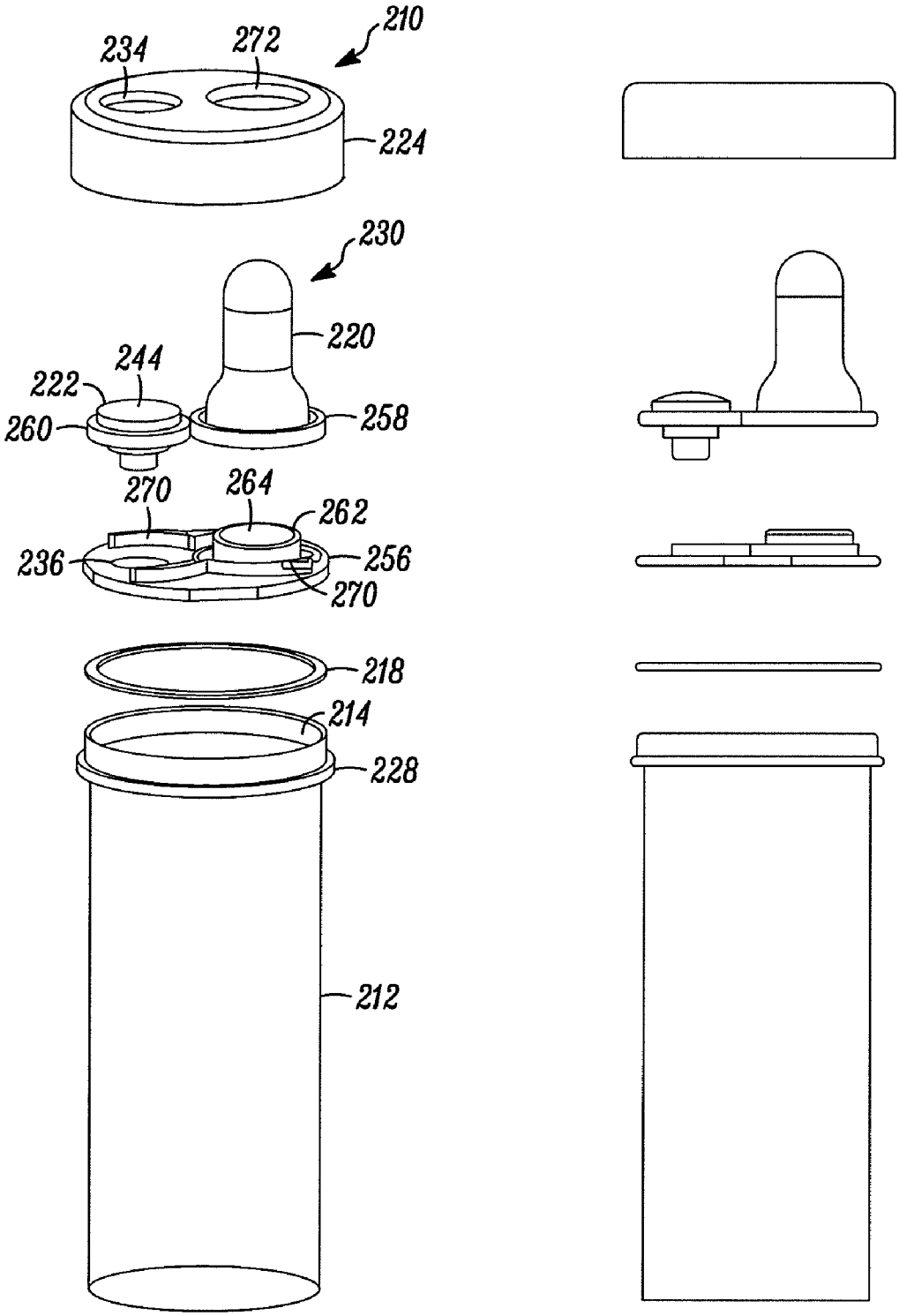
FIG. 9 is an exploded, perspective view of a third embodiment of a container of the present invention.
Figure 10:
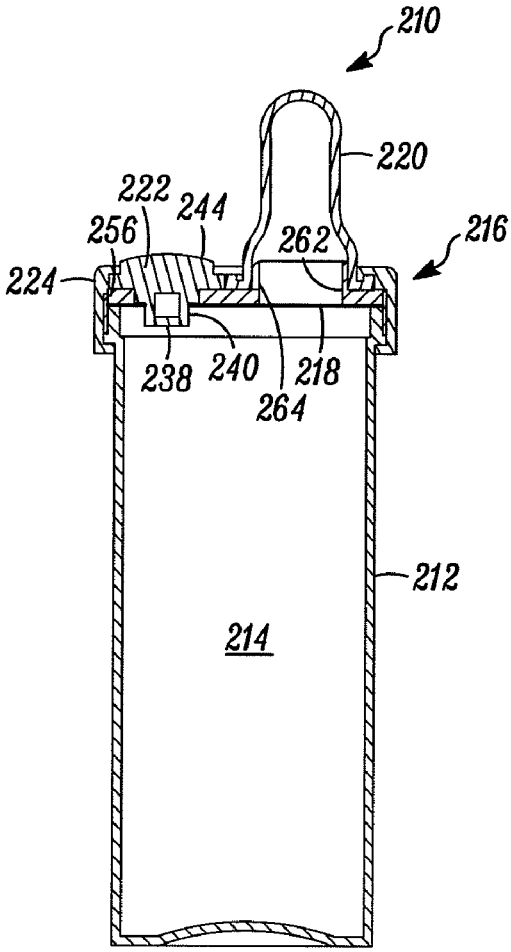
FIG. 10. is a cross-sectional view of the container of FIG. 9.
Figure 11:
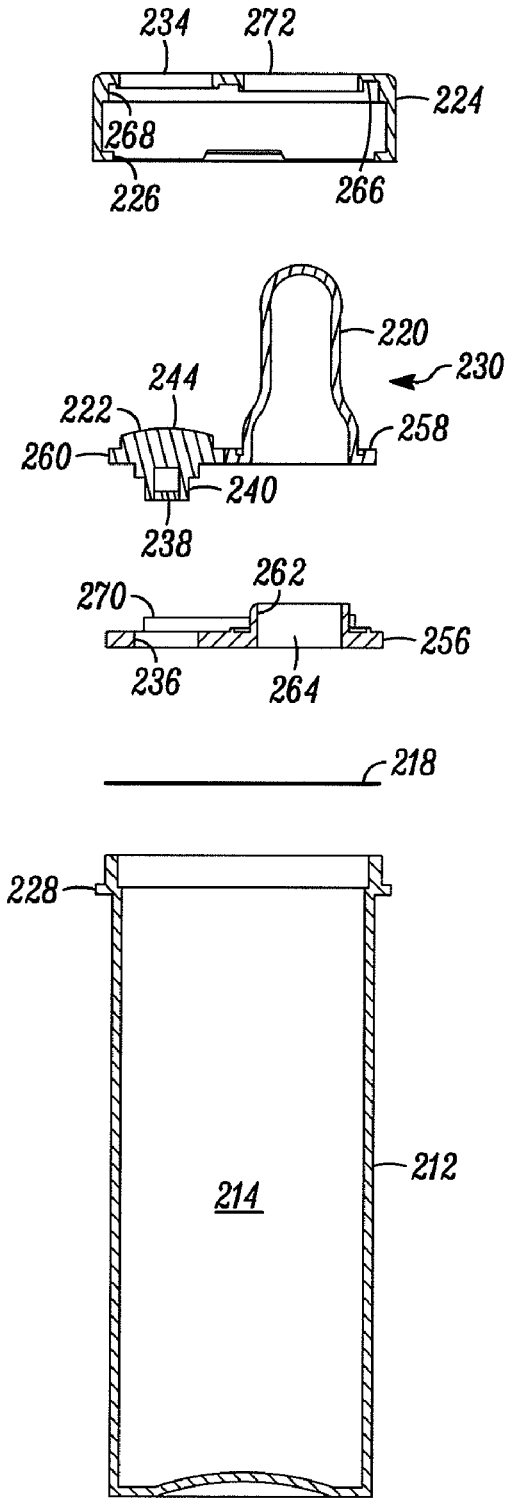
FIG. 11 is an exploded, cross-sectional view of the container of FIG. 9.

In FIGS. 9 through 11 another container embodying the present invention is indicated generally by the reference numeral 210. The container 210 is substantially similar to the containers 10 and 100 described above with reference to FIGS. 1 through 8, and therefore like reference numerals preceded by the numeral "2", or preceded by the numeral "2" instead of the numeral "1", are used to indicate like elements. The primary difference of the container 210 in comparison to the containers 10 and 110 is that the components of the container closure 216 are assembled by mechanical compression. The container closure 216 further includes a first relatively rigid container closure member 256 mounted on the body 212, a sealing member 218 that forms a substantially fluid-tight seal between the first relatively rigid container closure member 256 and the body 212, and a second relatively rigid container closure member formed by the cap 224 mounted over the first relatively rigid container closure member 256 with the base portions of the stopper 222 and nipple 220 sandwiched and thereby fixedly secured therebetween. If desired, the sealing member 218 can be fixedly secured to the first relatively rigid container closure member 256, such as by ultrasonic welding, the use of an adhesive, co-molding, or any of numerous other connecting mechanisms that are currently known, or that later become known. The nipple 220 defines a peripheral flange 258 extending about the peripheral portion of the base of the nipple and that is fixedly secured and compressed between the first and second relatively rigid container closure members 256 and 224, respectively, to form a fluid-tight seal therebetween. Similarly, the stopper 222 defines a peripheral flange 260 that is fixedly secured and compressed between the first and second relatively rigid container closure members 256 and 224, respectively, to form a fluid-tight seal therebetween. The first relatively rigid container closure member 256 defines a substantially cylindrical boss 262 that is received within the base portion of the nipple 220 to support the nipple, and a fluid flow aperture 264 extends through the boss for allowing fluid communication between the nipple 220 and chamber 214. As shown in FIG. 10, the cap 224 defines on its underside a first circular recess or groove 266 for receiving therein the peripheral flange 258 of the nipple 220 and compressing the nipple flange 258 upon attachment of the container closure 216 to the body 212. The cap 224 further defines on its underside a second circular recess or groove 268 for receiving therein the peripheral flange 260 of the stopper 222 and compressing the stopper flange 260 upon attachment of the container closure 216 to the body 212. The first relatively rigid container closure member 256 defines sealing walls 270 spaced laterally relative to the stopper aperture 236 and nipple boss 264 and extending adjacent to substantial portions of the peripheries thereof for contacting the stopper flange 260 and nipple flange 258, respectively, and to thereby facilitate forming fluid-tight seals between each of the stopper and nipple and the container closure members. The cap 224 defines a nipple aperture 272 for receiving therethrough the nipple 220, and a stopper aperture 234 for receiving therein the stopper 222. The cap 224 defines a first connecting flange 226 extending about the peripheral base of the cap, and the body 212 defines a second connecting flange 228 extending about the periphery of the mouth of the body. The first connecting flange 226 defines a tapered axially-exposed surface to facilitate sliding the first connecting flange 226 over the second connecting flange 228 to snap fit the cap 224 to the body 212 and, in turn, fixedly connect the container closure 216 to the body 212. The axial distance between the first connecting flange 226 and the underside of the cap 224 is set to define a substantially predetermined compression of the peripheral flange 258 of the nipple 220, and of the peripheral flange 260 of the stopper 222 to effect fluid-tight seals when the cap 224 is snap fit to the body 212. As can be seen, the container body 212 defines a more axially-elongated shape than the container bodies 10 and 110 described above. As may be recognized by those of ordinary skill in the pertinent art based on the teachings herein, the container bodies and components of the container closures may take any of numerous different shapes and/or configurations that are currently known, or that later become known.

Figure 12:
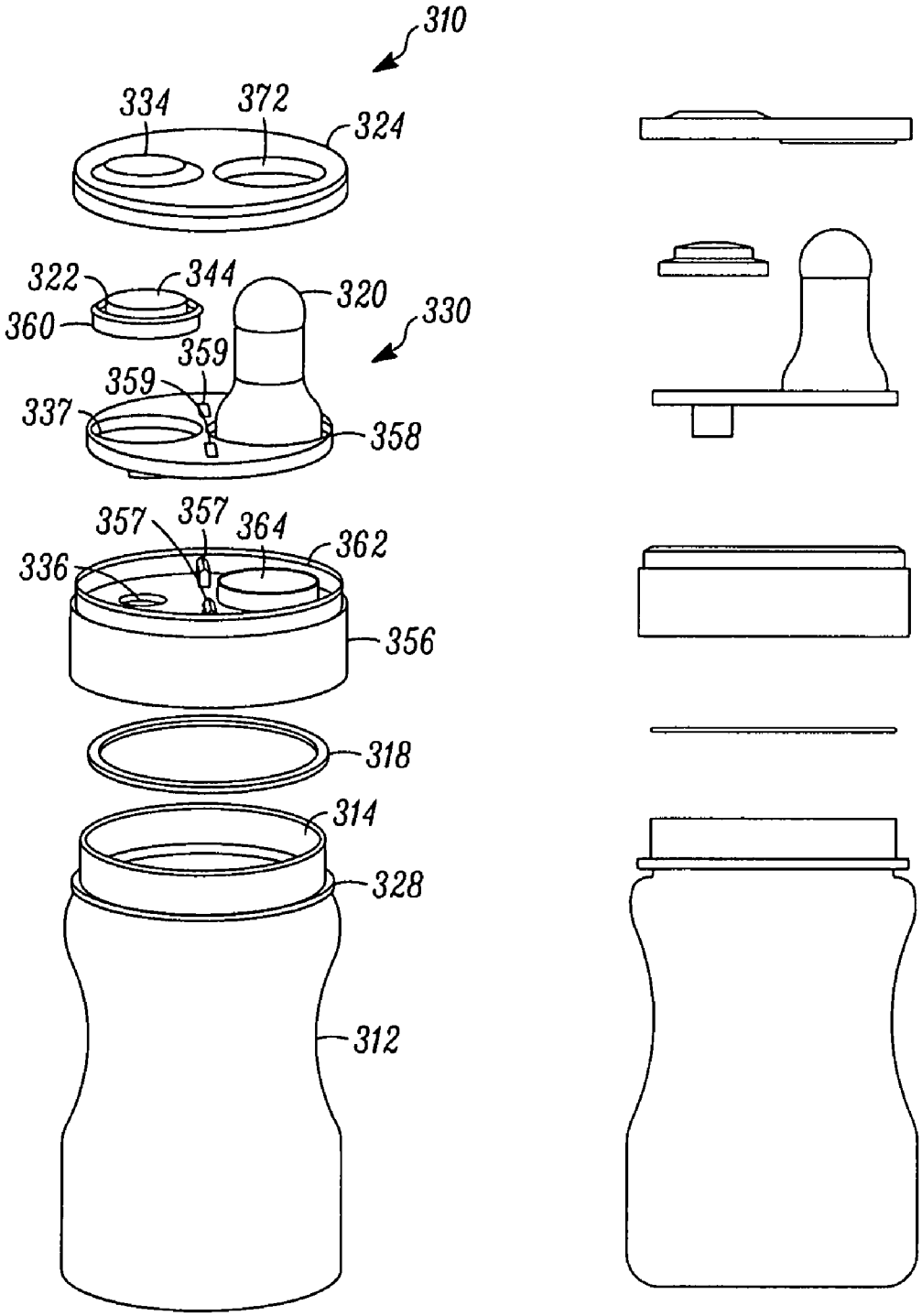
FIG. 12 is an exploded, perspective view of a fourth embodiment of a container of the present invention.
Figure 13:
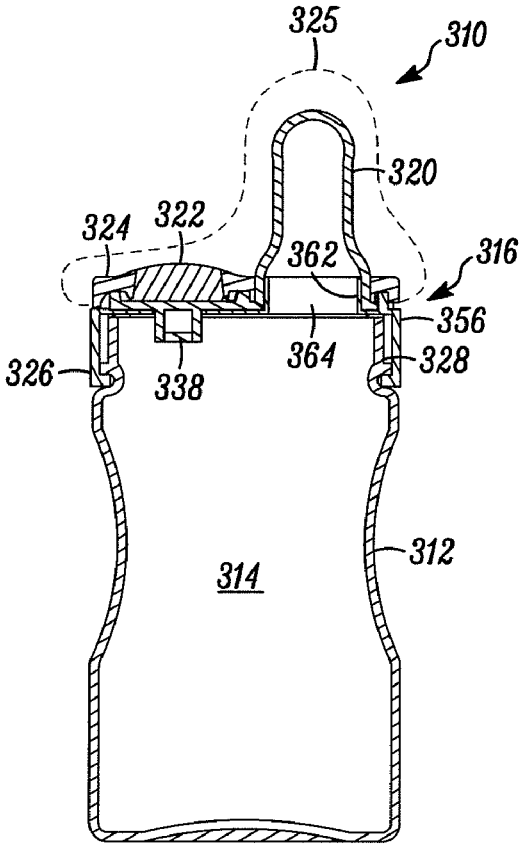
FIG. 13 is a cross-sectional view of the container of FIG. 12.
Figure 14:
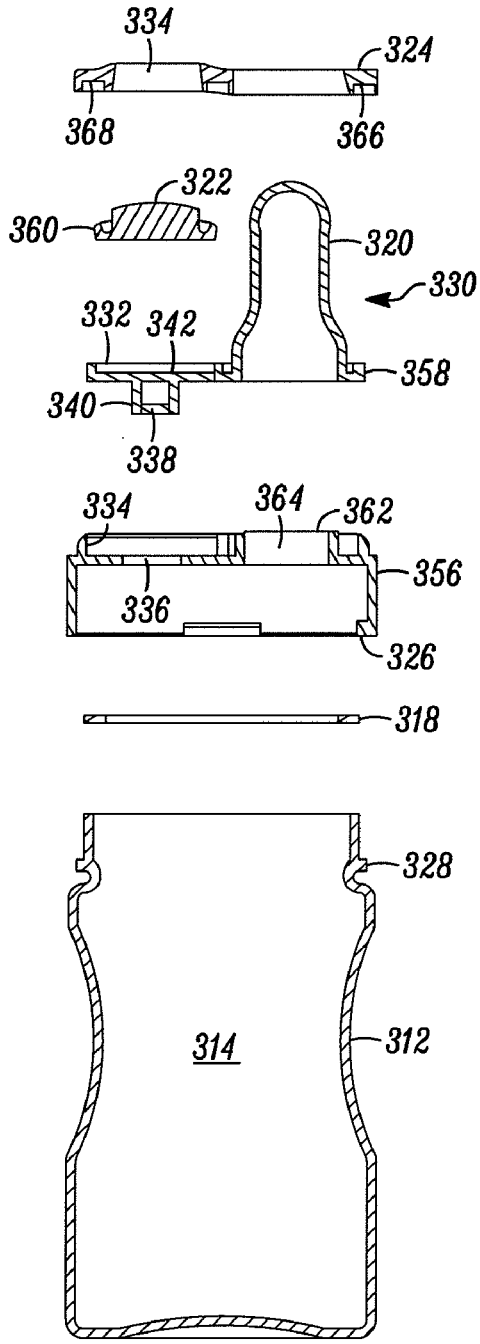
FIG. 14 is an exploded cross-sectional view of the container of FIG. 12.

In FIGS. 12 through 14 another container embodying the present invention is indicated generally by the reference numeral 310. The container 310 is substantially similar to the containers 10, 110 and 210 described above with reference to FIGS. 1 through 11, and therefore like reference numerals preceded by the numeral "3", or preceded by the numeral "3" instead of the numerals "1" or "2", are used to indicate like elements. The primary difference of the container 310 in comparison to the container 210 is in the geometries of the container closure components. As can be seen, the first relatively rigid container closure member 356 includes the first connecting flange 326 extending about the peripheral base of the first container closure member to snap fit, and thereby fixedly secure the container closure 316 to the body 312. In addition, the first material portion 330 defines a stopper recess 332 for receiving therein the stopper 322, and defines a base wall 342 that forms a barrier between the stopper and the chamber 314, and thus substantially prevents any contact between the stopper and any product contained within the chamber 314. In a currently preferred embodiment of the present invention, the material forming the first material portion 330 is sufficiently elastic to substantially reseal itself after being penetrated by a filling needle or like injection member, and therefore even after needle penetration the base wall 342 substantially prevents any contact between the stopper and product contained within the chamber 314. The first material portion 330 also defines the injection member contacting surface 338 and associated boss 340 extending downwardly from the base wall 342 of the stopper recess 332. The peripheral flange 360 of the stopper 322 defines an annular recess formed at the junction of the flange and stopper body, and the first container closure member 356 defines a corresponding annular projection formed at the inner edge of the recess 368 that is received within the annular recess of the stopper to effect a fluid-tight seal therebetween. The second relatively rigid container closure member or cap 324 overlies the first container closure member 356 and is fixedly secured thereto. In the illustrated embodiment, and as shown best in FIG. 12, the first container closure member 356 includes a pair of connecting bosses 357 that are laterally spaced relative to each other on the upper surface of the first container closure member 356. The first material portion 330 includes a pair of boss apertures 359 for receiving therethrough the connecting bosses 357. In the illustrated embodiment, the connecting bosses 357 are fixedly secured to the second container closure 324 by ultrasonic welding; however, the two container closure members can be secured to each other in any of numerous other ways that are currently known, or that later become known. As can be seen, the body 312 of the container defines a different shape than the container bodies described above, and includes a relatively narrow central region to facilitate gripping of the container body. As shown typically in broken lines in FIG. 13, the container 310 further includes an over cap 325 releasably connected to the body 312 and/or the container closure 316 and forming a substantially fluid-tight seal therebetween. The over cap 325 is of a type known to those of ordinary skill in the pertinent art that seals at least the nipple 320 and stopper 322 with respect to the ambient atmosphere, and preferably seals the entire container closure 316 as illustrated, and forms a barrier substantially preventing oxygen and vapor transmission therethrough. Each of the other embodiments of the container described above (10, 110 and 210) preferably also include the same or a similar over cap.

The sterile, empty container and closure assemblies 10 may be needle filled and thermally resealed in accordance with the teachings of any of the following patent applications and patents that are hereby incorporated by reference in their entireties as part of the present disclosure: U.S. patent application Ser. No. 10/766,172 filed Jan. 28, 2004, entitled "Medicament Vial Having A Heat-Sealable Cap, And Apparatus and Method For Filling The Vial", which is a continuation-in-part of similarly titled U.S. patent application Ser. No. 10/694,364, filed Oct. 27, 2003, which is a continuation of similarly titled co-pending U.S. patent application Ser. No. 10/393,966, filed Mar. 21, 2003, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; similarly titled U.S. Provisional Patent Application No. 60/443,526, filed Jan. 28, 2003; similarly titled U.S. Provisional Patent Application No. 60/484,204, filed Jun. 30, 2003; U.S. patent application Ser. No. 10/655,455, filed Sep. 3, 2003, entitled "Sealed Containers And Methods Of Making And Filling Same"; U.S. patent application Ser. No. 10/983,178 filed Nov. 5, 2004, entitled "Adjustable Needle Filling and Laser Sealing Apparatus and Method; U.S. patent application Ser. No. 11/070,440 filed Mar. 2, 2005, entitled "Apparatus and Method for Needle Filling and Laser Resealing"; U.S. patent application Ser. No. 11/074,513 filed Mar. 7, 2005, entitled "Apparatus for Molding and Assembling Containers with Stoppers and Filling Same; U.S. patent application Ser. No. 11/074,454 filed Mar. 7, 2005, entitled "Method for Molding and Assembling Containers with Stoppers and Filling Same"; and U.S. patent application Ser. No. 11/339,966, filed Jan. 25, 2006, entitled "Container Closure With Overlying Needle Penetrable And Thermally Resealable Portion And Underlying Portion Compatible With Fat Containing Liquid Product, And Related Method".

As indicated above, the second material portion or stopper 22 is preferably co-molded with the cap 24, such as by overmolding the second material portion to the cap. In addition, the second material portion 30 can be co-molded with the cap and stopper, such by over molding the second material portion to the cap, or vice versa. If desired, the container closure may be molded in the same mold as the container body, or may be molded in adjacent molding machines, and at least one of the container closure and the body may be assembled within or adjacent to the mold in accordance with the teachings of commonly-assigned U.S. patent application Ser. Nos.

11/074,454 and 11/074,513 incorporated by reference below, and U.S. Provisional Patent Application Ser. No. 60/727,899 filed Oct. 17, 2005, entitled "Sterile De-Molding Apparatus And Method", which is hereby expressly incorporated by reference as part of the present disclosure. [update to include the Intact de-molding applications]. One advantage of this approach is that the container is closed to define a sealed, empty sterile chamber at essentially the time of formation, and the container is never opened (through filling, resealing, and during shelf life) until the product is dispensed. Accordingly, a significantly high level of sterility assurance can be achieved.

Figure 15:
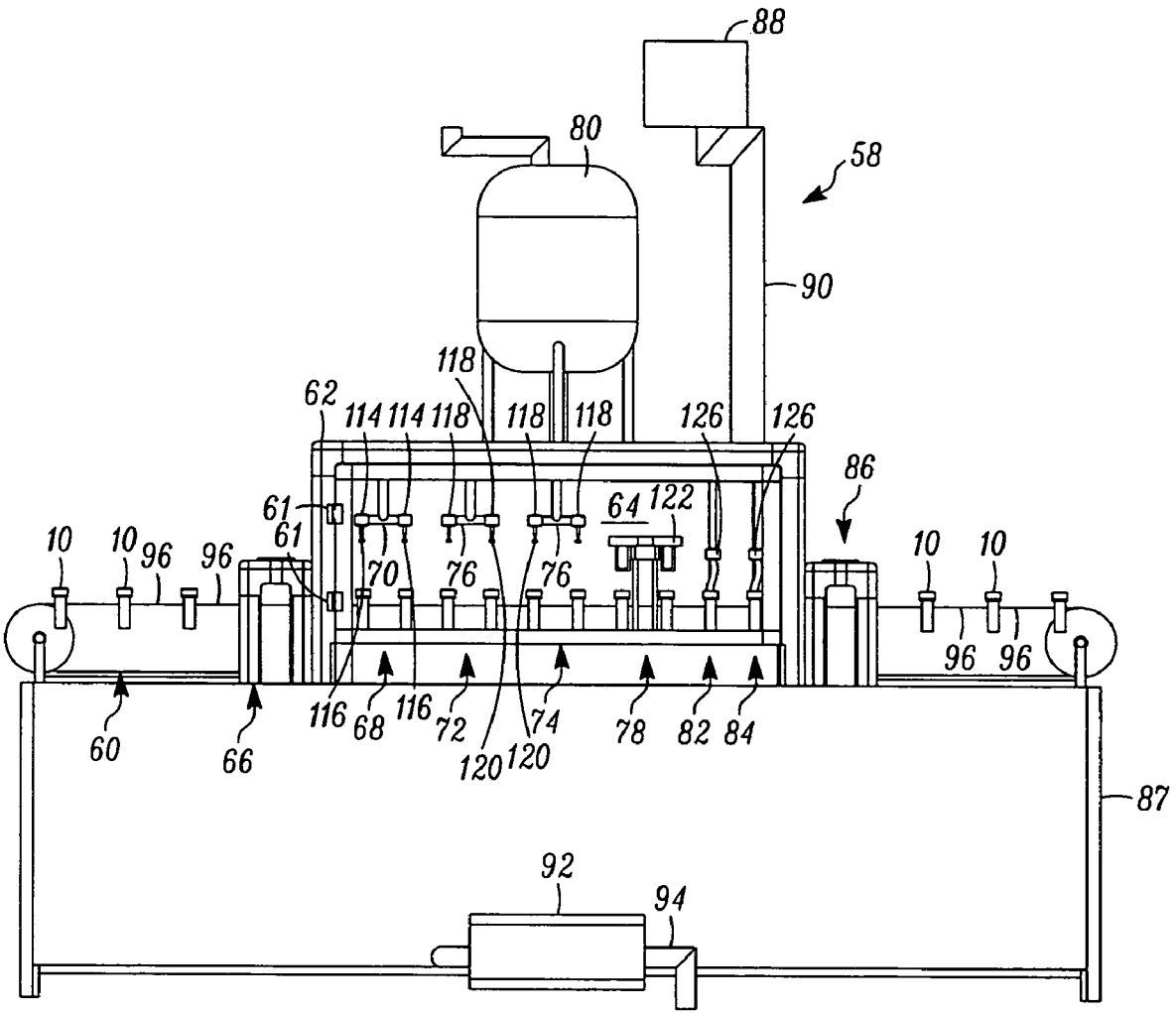
FIG. 15 is a side elevational view of an apparatus for needle filling and laser resealing the containers.
Figure 16:
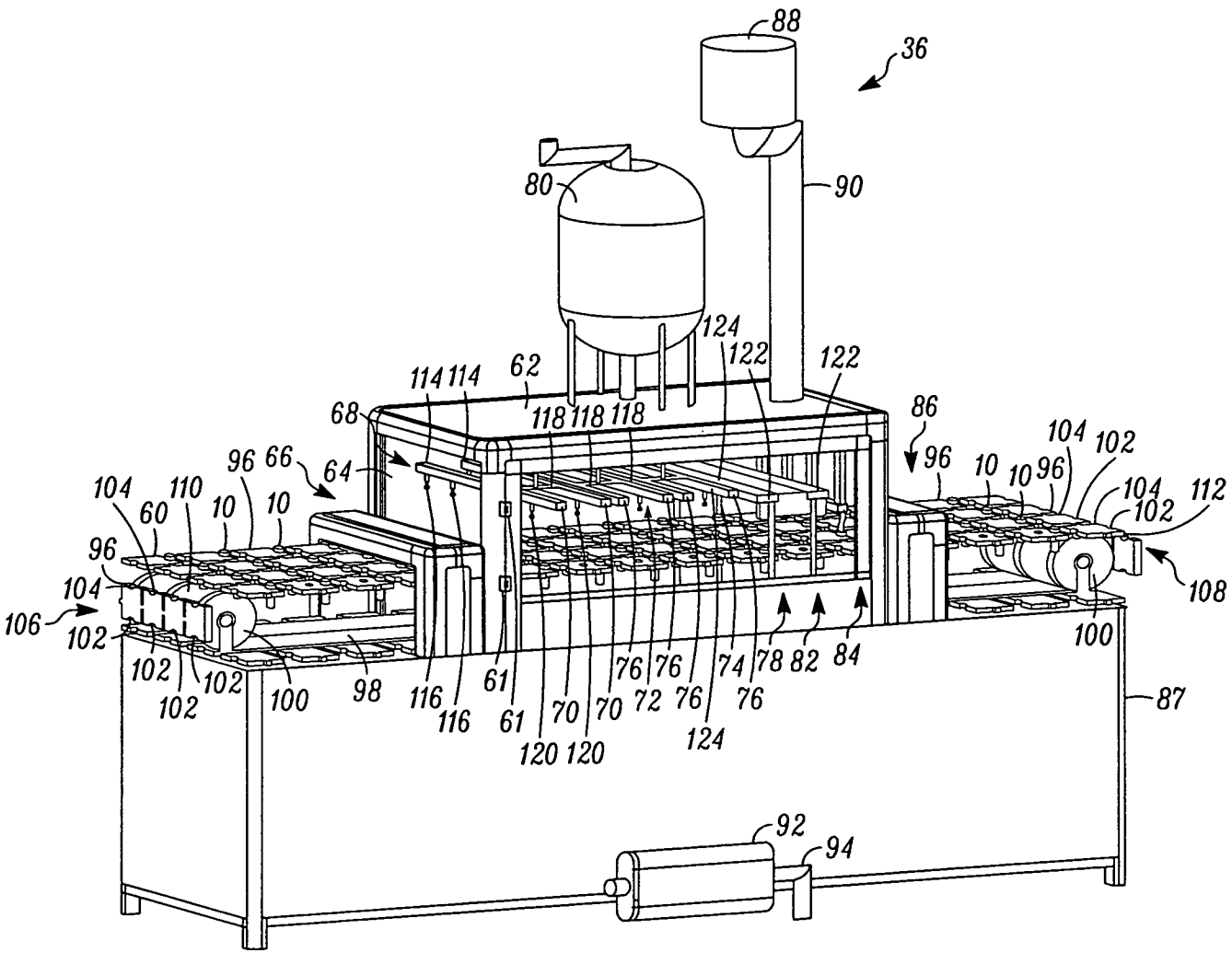
FIG. 16 is a perspective view of the apparatus of FIG. 15.

In FIGS. 15 and 16, an exemplary needle filling and laser resealing apparatus for use in filling and resealing the containers of the present invention is indicated generally by the reference numeral 58. The apparatus 58 includes a closed loop or endless conveyor 60 for indexing and thereby conveying the containers through the apparatus. Although in FIGS. 15 and 16 the containers are indicated with the reference numeral 10, the containers equally may be any of the other containers disclosed herein (containers 110, 210 and 310), or any of any of numerous other types of containers embodying one or more aspects of the present invention. The containers 10 that are fed by the conveyor 60 into the apparatus 58 include the container closures 16 fixedly secured to the bodies 12, but do not include the over caps referenced above. The interior chamber 14 of each container is sterile, such as by assembling the container closures and bodies in the mold and/or within a sterile zone within or adjacent to the mold as described in any of the co-pending patent applications incorporated by reference above, by transmitting radiation, such as gamma or ebeam radiation, onto the sealed, empty container closure and body assembly, or by employing a fluid sterilant, such as vaporized hydrogen peroxide. The apparatus 58 includes an elongated housing 62 defining within it a sterile zone 64 and through which the conveyor 60 with the containers 10 located thereon passes. The term "sterile zone" is used herein within the meaning of the applicable regulatory guidelines as promulgated, for example, by the FDA (the United States Food and Drug Administration) or other national or applicable regulatory agency, and including applicable Low Acid Canned Food ("LACF") regulations, and is preferably defined by a commercially sterile area that is maintained sterile by means of an over pressure of sterile air in a manner known to those of ordinary skill in the pertinent art. In the illustrated embodiment, the housing 62 includes side walls formed by see-through panels in order to allow an operator to view the interior of the apparatus. If desired, however, the side walls could be opaque, or could include an arrangement of opaque and see-through portions different than that shown. As shown, one or more of the side panels may be mounted to the housing frame by hinges 61 in order to pivot the respective side panel outwardly to access the interior of the housing to, for example, perform maintenance and/or repairs. Otherwise, the side and top walls of the housing 62 are sealed with respect to the ambient atmosphere to maintain the sterility of the sterile zone 64.

The apparatus 58 includes on its inlet end an inlet transfer station 66 through which the conveyor 60 passes for transferring the containers 10 mounted on the conveyor 60 into the sterile zone 64. A sterilizing station 68 is located within the housing 62 immediately downstream of the inlet transfer station 66 in the direction of conveyor movement (clockwise in FIGS. 15 and 16) and includes one or more sterilizing heads 70 coupled to a source of fluid sterilant (not shown) such as a hydrogen peroxide, vaporized hydrogen peroxide sterilant ("VHP") or other fluid sterilant that is currently or later known, for transmitting the fluid sterilant onto the exterior surfaces of the containers to sterilize the exterior surfaces. The apparatus 58 further includes within the housing 62 a first sterilant removing station 72 located downstream of the sterilizing station 68 in the direction of conveyor movement, and a second sterilant removing station 74 located downstream of the first sterilant removing station 72. Each sterilant removing station 72, 74 includes one or more respective sterilant flushing heads 76 for transmitting heated sterile air or other gas over the exterior surfaces of the containers at a sufficient temperature, flow rate and/or volume, and for a sufficient time period to substantially entirely remove the fluid sterilant therefrom. The vaporized peroxide may condense at least in part on the surfaces of the containers and/or conveyor, and therefore it is desirable to flush such surfaces with a heated, sterile air or other gas to re-vaporize any condensed hydrogen peroxide and flush it out of the sterile zone. In a currently preferred embodiment, the temperature of the sterile air is at least about 60° C.; however, as may be recognized by those of ordinary skill in the pertinent art based on the teachings herein, the temperature may be set as desired or otherwise required by a particular application. A needle filling station 78 is located within the housing 62 downstream of the second sterilant removing station 74 for needle filling each container 10 with product from a product fill tank 80, and first and second laser resealing stations 82 and 84, respectively, are located downstream of the needle filling station 78 for laser resealing the resulting needle holes formed in the stoppers of the containers after filling the containers and withdrawing the needles. An exit transfer station 86 is located downstream of the laser resealing stations 82, 84 for transferring the filled containers 10 on the conveyor 60 out of the sterile zone 64. After exiting the sterile zone 64, the containers 10 are capped with the over caps and ready for shipment.

The over pressure of sterile air or other gas is provided by a sterile gas source 88 including one or more suitable filters, such as HEPA filters, for sterilizing the air or other gas prior to introducing same into the sterile zone 64. A fluid conduit 90 is coupled in fluid communication between the sterile air source 88 and the sterile zone 64 for directing the sterile air into the sterile zone. The apparatus 58 includes one or more vacuum pumps or other vacuum sources (not shown) mounted within a base support 87 of the apparatus and of a type known to those of ordinary skill in the pertinent art. The vacuum source(s) are coupled in fluid communication with an exhaust manifold at the inlet transfer station 66 and an exhaust manifold at the exit transfer station 86 for drawing the air and fluid sterilant out of the sterile zone 64 and exhausting same through a catalytic converter 92 and exhaust conduit 94. The catalytic converter 92 is of a type known to those of ordinary skill in the pertinent art to break down the exhausted hydrogen peroxide into water and oxygen. In the illustrated embodiment, the exhaust manifolds are mounted at the base of the inlet and outlet stations and extend into the base support 87. As can be seen, the exhaust manifolds at the inlet and outlet stations 66 and 86, respectively, draw into the exhaust passageways located within the base support 87 (not shown) both sterile air and fluid sterilant from the sterile zone 64, and non-sterile ambient air located either within the inlet station or outlet station. As a result, any ambient non-sterile air (including any other ambient gases or contaminants) in the inlet and outlet stations are drawn into the exhaust manifolds, and thereby prevented from entering the sterile zone 64 to maintain the sterility of the sterile zone. Similarly, any sterile air or sterilant is substantially prevented from being re-circulated within the sterile zone, and instead, is drawn into the exhaust manifolds after passage over the containers and/or conveyor portion located within the sterile zone. If desired, one or more exhaust manifolds may be located at the base of the sterile zone (i.e., beneath the conveyor 60 or between the overlying and underlying portions of the conveyor 60) for fully exhausting the air and fluid sterilant and otherwise for avoiding the creation of any "dead" zones where air and/or fluid sterilant may undesirably collect. In one embodiment of the present invention, the flow of sterile air within the sterile zone 64 is controlled to cause the air to flow generally in the direction from right to left in FIG. 15 (i.e., in the direction from the needle filling station 78 toward the sterilizing station 68) to thereby prevent any fluid sterilant from flowing into the needle filling and laser resealing stations 78, 82 and 84. This flow pattern may be effected by creating a higher vacuum at the inlet station 66 in comparison to the outlet station 86. However, as may be recognized by those of ordinary skill in the pertinent art based on the teachings herein, this flow pattern or other desired flow patterns may be created within the sterile zone in any of numerous different ways that are currently known, or that later become known.

In the illustrated embodiment, the conveyor 60 includes a plurality of flights or like holding mechanisms 96 that clamp each container 10 at or below its neck finish (i.e., at the peripheral region immediately below the mouth of the body 12, or at or below the junction of the container closure 16 and body 12) or other desired container region. The flights 96 are pivotally mounted on a belt 98 defining a closed loop and rotatably mounted on rollers 100 located on opposite sides of the apparatus relative to each other. One or more drive motors and controls (not shown) may be mounted within the base support 87 and are coupled to one or both rollers 100 for rotatably driving the conveyor 60 and, in turn, controlling movement of the containers 10 through the apparatus in a manner known to those of ordinary skill in the pertinent art. Each flight 96 of the conveyor 60 includes a plurality of container-engaging recesses 102 laterally spaced relative to each other and configured for engaging the respective necks or other desired portions of the containers 10 to support the containers on the conveyor. Although the container-engaging recesses 102 are illustrated as being semi-circular in order to engage the containers 10, they equally may be formed in any of numerous different shapes that are currently known, or that later become known, in order to accommodate any desired container shape, or otherwise as desired. The flights 96 further define a plurality of vent apertures 104 that are laterally spaced relative to each other, and are formed between and adjacent to the container-engaging recesses 102. The vent apertures 104 are provided to allow the sterile air and fluid sterilant to flow over the portions of the containers 10 located above the flights 96 of the conveyor and, in turn, through the conveyor prior to being exhausted through the exhaust manifolds. In the illustrated embodiment, the vent apertures 104 are provided in the form of elongated slots; however, as may be recognized by those of ordinary skill in the pertinent art based on the teachings herein, the vent apertures may take any of numerous different configurations that are currently known, or that later become known. Preferably, the flights 96 laterally engage the neck portions of the containers 10, and effectively isolate the sterile portions of the containers above the flights from the portions of the containers located below the flights that may not be sterile, or that may include surface portions that are not sterile.

The conveyor 60 defines an inlet end 106 for receiving the containers 10 to be fed into the apparatus, and an outlet end 108 for removing the filled and laser resealed containers from the apparatus. As can be seen, the adjacent flights 96 located at the inlet and outlet ends 106 and 108, respectively, are pivoted relative to each other upon passage over the rollers 100 to thereby define a loading gap 110 at the inlet end of the conveyor and an unloading gap 112 at the outlet end of the conveyor. Accordingly, at the inlet end, the containers 10 may be fed on their sides into the loading gap 110 and received within the container-engaging recesses 102 of the respective flight 96. Then, as the conveyor 60 is rotated in the clockwise direction in FIGS. 15 and 16, the opposing flights 96 are pivoted toward each other to thereby engage the containers 10 between the opposing recesses 102 of adjacent flights. Similarly, at the outlet end 108, the formation of the unloading gap 112 between the respective flights 96 allows the containers loaded thereon to be removed from the conveyor. Any of numerous different devices for automatically, semi-automatically, or manually loading and/or unloading the containers onto the conveyor that are currently known, or that later become known, may be employed. In addition, any of numerous different apparatus that are currently known, or that later become known, may be employed to cap the filled containers after exiting the sterile zone. As may be recognized by those of ordinary skill in the pertinent art based on the teachings herein, the conveyor, the devices for holding the containers onto the conveyor, and/or the apparatus for driving and/or controlling the conveyor may take any of numerous different configurations that are currently known, or that later become known.

In the illustrated embodiment, each flight 96 of the conveyor is configured to hold four containers 10 spaced laterally relative to each other. Accordingly, in the illustrated embodiment, each sterilizing head 70 located within the sterilizing station 70 includes two sterilant manifolds 114, and four sterilizing nozzles 116 mounted on each sterilant manifold. Each sterilizing nozzle 116 is located over a respective container position on the conveyor to direct fluid sterilant onto the respective container. Similarly, each sterilant flushing head 76 located within the sterilant removing stations 72 and 74 includes two flushing manifolds 118, and each flushing manifold 118 includes four flushing nozzles 120. Each flushing nozzle 120 is located over a respective container position on the conveyor to direct heated sterile air or other gas onto the respective container to re-vaporize if necessary and flush away the fluid sterilant. In the illustrated embodiment, the conveyor 60 is indexed by two rows of containers (or flights) at a time, such that at any one time, two rows of containers are each being sterilized, needle filled, and laser resealed within the respective stations, and four rows of containers are being flushed within the two sterilant removing stations (i.e., the first sterilant removing station 72 applies a first flush, and the second sterilant removing station 74 applies a second flush to the same containers). When each such cycle is completed, the conveyor is indexed forward (or clockwise in FIGS. 15 and 16) a distance corresponding to two rows of containers, and the cycle is repeated. As may be recognized by those of ordinary skill in the pertinent art based on the teachings herein, the apparatus may define any desired number of stations, any desired number of container positions within each station, and if desired, any desired number of apparatus may be employed to achieve the desired throughput of containers.

The needle filling station 78 comprises a needle manifold 122 including a plurality of needles 124 spaced relative to each other and movable relative to the flights 96 on the conveyor 60 for penetrating a plurality of containers 10 mounted on the portion of the conveyor within the filling station, filling the containers through the needles, and withdrawing the needles from the filled containers. Each of the laser resealing stations 82 and 84 comprises a plurality of laser optic assemblies 126, and each laser optic assembly is located over a respective container position of the conveyor flights located within the respective laser resealing station. Each laser optic assembly is connectable to a source of laser radiation (not shown), and is focused substantially on a penetration spot on the stopper 22 of the respective container 10 for applying laser radiation thereto and resealing the respective needle aperture. Also in the illustrated embodiment, each laser resealing station 82 and 84 further comprises a plurality of optical sensors (not shown). Each optical sensor is mounted adjacent to a respective laser optic assembly 126 and is focused substantially on the laser resealed region of a stopper 22 of the respective laser optic assembly, and generates signals indicative of the temperature of the laser resealed region to thereby test the integrity of the thermal seal.

In one embodiment of the present invention, a non-coring filling needle 124 defines dual channels (i.e., a double lumen needle), wherein one channel introduces the substance into the storage chamber 14 and the other channel withdraws the displaced air and/or other gas(es) from the storage chamber. In another embodiment, a first non-coring needle introduces the substance into the chamber and a second non-coring needle (preferably mounted on the same needle manifold for simultaneously piercing the stopper) is laterally spaced relative to the first needle and withdraws the displaced air and/or other gas(es) from the chamber. In another embodiment, grooves are formed in the outer surface of the needle to vent the displaced gas from the storage chamber. In one such embodiment, a cylindrical sleeve surrounds the grooves to prevent the septum material from filling or blocking the grooves (partially or otherwise) and thereby preventing the air and/or other gases within the container from venting therethrough. In each case, the channels or passageways may be coupled to a double head (or channel) peristaltic pump such that one passageway injects the product into the storage chamber, while the other passageway simultaneously withdraws the displaced air and/or other gases from the storage chamber. Also in some embodiments of the present invention, the product substantially entirely fills the chamber (or is filled to a level spaced closely to, or substantially in contact with the interior surface of the first material portion 30, but not in contact with the stopper).

In the illustrated embodiment of the present invention, the stopper (or penetrable and thermally resealable portion) is preferably made of a thermoplastic/elastomer blend, and may be the same material as those described in the co-pending patent applications and/or patents incorporated by reference above. Accordingly, in one such embodiment, the stopper (or penetrable and thermally resealable portion) is a thermoplastic elastomer that is heat resealable to hermetically seal the needle aperture by applying laser radiation at a predetermined wavelength and power thereto, and defines (i) a predetermined wall thickness, (ii) a predetermined color and opacity that substantially absorbs the laser radiation at the predetermined wavelength and substantially prevents the passage of radiation through the predetermined wall thickness thereof, and (iii) a predetermined color and opacity that causes the laser radiation at the predetermined wavelength and power to hermetically seal the needle aperture formed in the needle penetration region thereof in a predetermined time period of less than or equal to about 5 seconds and substantially without burning the needle penetration region.

In one embodiment, the stopper (or penetrable and thermally resealable portion) is a thermoplastic elastomer that is heat resealable to hermetically seal the needle aperture by applying laser radiation at a predetermined wavelength and power thereto, and includes (i) a styrene block copolymer; (ii) an olefin; (iii) a predetermined amount of pigment that allows the second material portion to substantially absorb laser radiation at the predetermined wavelength and substantially prevent the passage of radiation through the predetermined wall thickness thereof, and hermetically seal the needle aperture formed in the needle penetration region thereof in a predetermined time period of less than or equal to about 5 seconds; and (iv) a predetermined amount of lubricant that reduces friction forces at an interface of the needle and second material portion during needle penetration thereof. In one such embodiment, the second material portion includes less than or equal to about 40% by weight styrene block copolymer, less than or equal to about 15% by weight olefin, less than or equal to about 60% by weight mineral oil, and less than or equal to about 3% by weight pigment and any processing additives of a type known to those of ordinary skill in the pertinent art. The term "pigment" is used herein to mean any of numerous different substances or molecular arrangements that enable the material or material portion within which the substance or molecular arrangement is located to substantially absorb laser radiation at the predetermined wavelength and, in turn, transform the absorbed energy into heat to melt the respective material or material portion and reseal an aperture therein.

In one embodiment, the stopper (or penetrable and thermally resealable portion) is a thermoplastic elastomer that is heat resealable to hermetically seal the needle aperture by applying laser radiation at a predetermined wavelength and power thereto, and includes (i) a first polymeric material in an amount within the range of about 80% to about 97% by weight and defining a first elongation; (ii) a second polymeric material in an amount within the range of about 3% to about 20% by weight and defining a second elongation that is less than the first elongation of the first polymeric material; (iii) a pigment in an mount that allows the second material portion to substantially absorb laser radiation at the predetermined wavelength and substantially prevent the passage of radiation through the predetermined wall thickness thereof, and hermetically seal a needle aperture formed in the needle penetration region thereof in a predetermined time period of less than or equal to about 5 seconds; and (iv) a lubricant in an amount that reduces friction forces at an interface of the needle and second material portion during needle penetration thereof.

In one embodiment of the invention, the pigment is sold under the brand name Lumogen™ IR 788 by BASF Aktiengesellschaft of Ludwigshafen, Germany. The Lumogen IR products are highly transparent selective near infrared absorbers designed for absorption of radiation from semiconductor lasers with wavelengths near about 800 nm. In this embodiment, the Lumogen pigment is added to the elastomeric blend in an amount sufficient to convert the radiation to heat, and melt the stopper material, preferably to a depth equal to at least about ⅓ to about ½ of the depth of the needle hole, within a time period of less than or equal to about 5 seconds, preferably less than about 3 seconds, and most preferably less than about 1½ seconds. The Lumogen IR 788 pigment is highly absorbent at about 788 nm, and therefore in connection with this embodiment, the laser preferably transmits radiation at about 788 nm (or about 800 nm). One advantage of the Lumogen IR 788 pigment is that very small amounts of this pigment can be added to the elastomeric blend to achieve laser resealing within the time periods and at the resealing depths required or otherwise desired, and therefore, if desired, the needle penetrable and laser resealable stopper may be transparent or substantially transparent. This may be a significant aesthetic advantage. In one embodiment of the invention, the Lumogen IR 788 pigment is added to the elastomeric blend in a concentration of less than about 150 ppm, is preferably within the range of about 10 ppm to about 100 ppm, and most preferably is within the range of about 20 ppm to about 80 ppm. In this embodiment, the power level of the 800 nm laser is preferably less than about 30 Watts, or within the range of about 8 Watts to about 18 Watts.

In one embodiment of the present invention, the substance or product contained within the storage chamber is a fat containing liquid product, such as infant or baby formula, and the stopper, second material portion, first container closure member, any other components of the container closure that is exposed to potential direct contact with the product stored within the chamber, and the body 12 each are selected from materials (i) that are regulatory approved for use in connection with nutritional foods, and preferably are regulatory approved at least for indirect contact, and preferably for direct contact with nutritional foods, (ii) that do not leach an undesirable level of contaminants or non-regulatory approved leachables into the fat containing product, such mineral oil, and (iii) that do not undesirably alter the taste profile (including no undesirable aroma impact) of the fat containing liquid product to be stored in the container. In certain embodiments of the invention, the penetrable and thermally resealable portion provides lesser or reduced barrier properties in comparison to the first material portion, and therefore the first material portion and/or over cap are selected to provide the requisite barrier properties of the container closure for purposes of storing the product to be contained therein.

In the embodiment of the present invention wherein the product is a fat containing liquid nutrition product, such as an infant or baby formula, exemplary materials for the stopper (penetrable and thermally resealable portion or first portion) are selected from the group including GLS 254-071, GLS LC254-071, GLS LC287-161, GLS LC287-162, C-Flex R70-001, C-Flex R70-005+ about 62.5 ppm Lumogen, C-Flex R70-005+ about 75 ppm Lumogen, Evoprene TS 2525 4213, Evoprene SG 948 4213, Evoprene G968-4179+ about 0.026% Carbon Black, Evoprene G968-4179+ about 62.5 ppm Lumogen and Cawiton 7193, modifications of any of the foregoing, or similar thermoplastic elastomers. In one such embodiment, the body 12 is an injection molded multilayer of PP/EVOH. In another such embodiment, the body 12 is blow molded, such as by extrusion blow molding, and is an HDPE/EVOH multi layer. In some such embodiments, the first material portion 30 is selected from the group including (i) a low mineral oil or mineral oil free thermoplastic; (ii) a low mineral oil or mineral oil free thermoplastic defining a predetermined durometer; (iii) a liquid injection moldable silicone; and (iv) a silicone. The predetermined durometer is within the range of about 20 Shore A to about 50 Shore A, and preferably is within the range of about 25 Shore A to about 35 Shore A. In some such embodiments, the first material portion is formed of polyethylene, an HDPE/TPE blend or multi layer, or a PP/TPE blend or multi layer. Also in some such embodiments, the over cap is made of a plastic sold under the trademark Celcon™, a PP/EVOH multi layer, an HDPE/EVOH multi layer or blend, or a HDPE/EVOH multi layer or blend. As may be recognized by those or ordinary skill in the pertinent art based on the teachings herein, these materials are only exemplary, and numerous other materials that are currently known, or that later become known, equally may be used.

As may be recognized by those skilled in the pertinent art based on the teachings herein, numerous changes and modifications may be made to the above-described and other embodiments of the present invention without departing from its scope as defined in the appended claims. For example, the nipple, stopper and other components of the container closure may be made of any of numerous different materials that are currently known, or that later become known for performing their functions and/or depending on the container application (s), including the product to be stored within the container. For example, the nipple may take any of numerous different configurations of nipples, and may be formed of any of numerous different nipple materials, that are currently known, or that later become known. As a further example, the penetrable and thermally resealable material may be blended with any of numerous different materials to obtain any of numerous different performance objectives. For example, any of the thermoplastic elastomers described above may be blended with, for example, small beads of glass or other insert beads or particles to enhance absorption of the laser radiation and/or to reduce or eliminate the formation of particles when needle penetrated. In addition, rather than form the stopper or penetrable and thermally resealable portion of a different material than the first material portion (or nipple), beads or particles of the thermally resealable material (that otherwise would form that stopper) may be blended with a cross-linked elastic material (that otherwise would form the first material portion) to thereby form a material blend that is both needle penetrable and thermally resealable, and that does not leach more than a predetermined amount of leachables into the product stored within the chamber. In addition, the body and container closure may take any of numerous different shapes and/or configurations, and may be adapted to receive and store within the storage chamber any of numerous different substances or products that are currently known or that later become known, including without limitation, any of numerous different food and beverage products, including low acid or fat containing liquid products, such as milk-based products, including without limitation milk, evaporated milk, infant formula, growing-up milks, condensed milk, cream, half-and-half, yoghurt, and ice cream (including dairy and non-diary, such as soy-based ice cream), other liquid nutrition products, liquid healthcare products, juice, syrup, coffee, condiments, such as ketchup, mustard, and mayonnaise, and soup, and pharmaceutical products. In addition, although described with reference to liquid products herein, the containers and filling apparatus and methods equally may be employed with gaseous, powdered, and semi-solid products. Accordingly, this detailed description of preferred embodiments is to be taken in an illustrative, as opposed to a limiting sense.

What is claimed is:

1. A container for storing a product, wherein the container is penetrable by an injection member for aseptically filling the container with a product through the injection member, and a resulting penetration hole in the container is thermally resealable to seal the product within the container, the container comprising:

a body defining a chamber for receiving the product; and a container closure including a sealing portion forming a substantially fluid-tight seal between the container closure and the body, and a nipple, wherein the container closure seals the chamber with respect to the ambient atmosphere during storage of the product in the chamber and can be opened to dispense product from the chamber through the nipple; and a penetrable and thermally resealable portion that is penetrable by the injection member for aseptically filling the chamber with the product through the injection member, and that is thermally resealable to seal the product within the chamber.

2. A container as defined in claim 1, wherein the nipple includes a sealing member that is movable between a first position sealing the nipple, and a second position opening the nipple and allowing product in the chamber to be dispensed therethrough.

3. A container as defined in claim 2, wherein the sealing member is frangibly connected to the nipple such that in the first position the sealing member is connected to the nipple, and in the second position the sealing member is disconnected from the nipple to form at least one opening in the nipple to allow product to be dispensed therethrough.

4. A container as defined in claim 1, wherein the nipple is defined by a first material portion forming an internal surface in fluid communication with the chamber and defining at least most of the surface area of the container closure that can contact any product within the chamber, and the penetrable and thermally resealable portion is defined by a second material portion that at least one of (i) overlies the first material portion and cannot contact any product within the chamber, and (ii) forms a substantially lesser surface area of the container closure that can contact any product within the chamber in comparison to the first material portion.

5. A container as defined in claim 4, wherein the product is a fat containing liquid product; the body does not leach more than a predetermined amount of leachables into the fat containing liquid product and does not undesirably alter a taste profile of the fat containing liquid product; the first material portion does not leach more than the predetermined amount of leachables into the fat containing liquid product or undesirably alter a taste profile of the fat containing liquid product, and the predetermined amount of leachables is less than about 100 PPM.

6. A container as defined in claim 1, wherein the sealing portion is engageable with the body prior to aseptically filling the chamber with the product and forms a substantially dry hermetic seal between the container closure and body.

7. A container as defined in claim 1, wherein the container closure further includes a securing portion connectable to the body for securing the container closure to the body.

8. A container as defined in claim 7, wherein the securing portion is at least one of threadedly connected to and snap fit to the body.

9. A container as defined in claim 7, wherein the securing portion is relatively rigid in comparison to the nipple and the penetrable and resealable portion, and is interposed therebetween.

10. A container as defined in claim 4, further comprising an injection member contacting member that contacts the injection member during withdrawal from the penetrable and resealable portion to substantially remove product thereon.

11. A container as defined in claim 10, wherein the injection member contacting member extends about a peripheral portion of the injection member and is in contact therewith.

12. A container as defined in claim 11, wherein the injection member contacting member is located on an underside of the penetrable and thermally resealable portion.

13. A container as defined in claim 12, wherein the injection member contacting member is defined by at least one of the first and second material portions.

14. A container as defined in claim 4, wherein the first material portion is selected from the group including (i) a low mineral oil or mineral oil free thermoplastic; (ii) a low mineral oil or mineral oil free thermoplastic defining a durometer within the range of about 20 Shore A to about 50 Shore A; (iii) a liquid injection moldable silicone; and (iv) a silicone.

15. A container as defined in claim 4, wherein the second material portion is a thermoplastic elastomer that is heat resealable to hermetically seal a penetration aperture by applying laser radiation at a predetermined wavelength and power thereto, and defines (i) a predetermined wall thickness, (ii) a predetermined color and opacity that substantially absorbs the laser radiation at the predetermined wavelength and substantially prevents the passage of radiation through the predetermined wall thickness thereof, and (iii) a predetermined color and opacity that causes the laser radiation at the predetermined wavelength and power to hermetically seal the penetration aperture in a predetermined time period of less than or equal to about 5 seconds and substantially without burning the second material portion.

16. A container as defined in claim 4, wherein the second material portion is a thermoplastic elastomer that is heat resealable to hermetically seal a penetration aperture by applying laser radiation at a predetermined wavelength and power thereto, and includes (i) a styrene block copolymer; (ii) an olefin; (iii) a predetermined amount of pigment that allows the second material portion to substantially absorb laser radiation at the predetermined wavelength and substantially prevent the passage of radiation through the predetermined wall thickness thereof, and hermetically seal the penetration aperture in a predetermined time period of less than or equal to about 5 seconds; and (iv) a predetermined amount of lubricant that reduces friction forces at an interface of the injection member and second material portion during penetration thereof.

17. A container as defined in claim 4, wherein the second material portion is a thermoplastic elastomer that is heat resealable to hermetically seal a penetration aperture by applying laser radiation at a predetermined wavelength and power thereto, and includes (i) a first polymeric material in an amount within the range of about 80% to about 97% by weight and defining a first elongation; (ii) a second polymeric material in an amount within the range of about 3% to about 20% by weight and defining a second elongation that is less than the first elongation of the first polymeric material; (iii) a pigment in an amount that allows the second material portion to substantially absorb laser radiation at the predetermined wavelength and substantially prevent the passage of radiation through the predetermined wall thickness thereof, and hermetically seal a penetration aperture in a predetermined time period of less than or equal to about 5 seconds; and (iv) a lubricant in an amount that reduces friction forces at an interface of the injection member and second material portion during penetration thereof.

18. A container as defined in claim 4, wherein the first material portion defines a penetration aperture, the second material portion overlies the penetration aperture, and the penetration aperture constitutes less than about 10% of the surface area of the first material portion exposed to the chamber.

19. A container as defined in claim 4, wherein the first material portion is interposed entirely between the second material portion and any product stored within the chamber to thereby prevent contact between the second material portion and product during storage thereof in the container.

20. A container as defined in claim 4, wherein the first material portion is co-molded with the second material portion.

21. A container as defined in claim 4, wherein the second material portion is compressed inwardly in at least a needle penetration region thereof to facilitate resealing a needle hole formed therethrough.

22. A container as defined in claim 21, wherein the second material portion is approximately dome-shaped.

23. A container as defined in claim 1, wherein the container closure defines a central region and the nipple is laterally spaced relative to the central region.

24. A container as defined in claim 1 defining a sealed, empty, sterile chamber ready to receive therein the product.

25. A container as defined in claim 1, further comprising an overcap coupled to at least one of the body and the container closure and forming a substantially fluid-tight seal therebetween, wherein the overcap seals at least the nipple with respect to the ambient atmosphere and forms a barrier substantially preventing oxygen and vapor transmission therethrough.

26. A container as defined in claim 1, wherein the container closure further includes a first relatively rigid container closure member mounted on the body forming a substantially fluid-tight seal formed between the first relatively rigid container closure member and the body, and a second relatively rigid container closure member mounted on the first relatively rigid container closure member, and wherein at least a portion of at least one of the nipple and the penetrable and thermally resealable portion is secured between the first and second relatively rigid container closure members.

27. A container as defined in claim 26, wherein the nipple defines a base portion extending about a periphery of the nipple and seated between the first and second relatively rigid container closure members, and the needle penetrable and thermally resealable portion defines a base portion seated between the first and second relatively rigid container closure members.

28. A container as defined in claim 27, wherein each base portion is compressed between the first and second relatively rigid container closure members.

29. A container as defined in claim 1, wherein the container closure includes one of: (i) the penetrable and thermally resealable portion, (ii) the nipple, and (iii) the penetrable and thermally resealable portion and the nipple.

30. A container for storing a product, wherein the container is penetrable by an injection member for aseptically filling the container with a product through the injection member, and a resulting penetration hole in the container is thermally resealable to seal the product within the container, the container comprising:

first means for providing a chamber for receiving the product; and second means for closing the chamber of the first means; wherein the second means includes third means for forming a substantially fluid-tight seal between the first means and the second means; fourth means for insertion into a user's mouth and drawing with the mouth product from the chamber therethrough; and fifth means for sealing the fourth means during storage of the product within the container and for opening the fourth means prior to dispensing product therethrough; and sixth means for allowing penetration of the second means by the injection member for aseptically filling the chamber with the product through the injection member, and for allowing thermal resealing of the second means to seal the product within the chamber.

31. A container as defined in claim 30, wherein the first means is a container body, the second means is a container closure, the third means is a sealing member, the fourth means is a nipple, the fifth means is a sealing member that is movable between a first position sealing the nipple and a second position opening the nipple and allowing product in the storage chamber to be dispensed therethrough, and the sixth means is a penetrable and thermally resealable elastomeric portion that is penetrable by the injection member for aseptically filling the chamber with the product through the injection member, and that is thermally resealable to seal the product within the chamber by the application of laser radiation thereto.

* * * * *